US006179686B1

(12) United States Patent
Ogawa et al.

(10) Patent No.: US 6,179,686 B1
(45) **Date of Patent: *Jan. 30, 2001**

(54) RUNNING TOY SYSTEM

(75) Inventors: Iwakichi Ogawa; Tatuo Kusumi, both of Tokyo (JP)

(73) Assignee: Sega Tech Ltd., Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/916,256

(22) Filed: Aug. 22, 1997

Related U.S. Application Data

(63) Continuation of application No. 08/441,317, filed on May 15, 1995, now abandoned.

(30) Foreign Application Priority Data

May 16, 1994 (JP) ..... 6-101426

(51) Int. Cl.[7] ..... A63H 29/00

(52) U.S. Cl. ..... 446/429; 446/441; 446/444; 446/484

(58) Field of Search ..... 446/429, 441, 446/444, 462, 484

(56) References Cited

U.S. PATENT DOCUMENTS

| | | | | |
|---|---|---|---|---|
| 2,788,613 | * | 4/1957 | Gelfand et al. | 446/429 |
| 2,832,177 | * | 4/1958 | Mueller | 446/462 |
| 3,471,963 | * | 10/1969 | Tomiyama | 446/429 |
| 3,707,805 | * | 1/1973 | Buck | 446/429 |
| 3,970,309 | * | 7/1976 | Sato | 446/197 |
| 4,260,041 | * | 4/1981 | Mabuchi | 446/429 |
| 4,363,186 | * | 12/1982 | Goldfarb et al. | 446/429 |
| 4,541,813 | * | 9/1985 | Ikeda | 446/429 |

FOREIGN PATENT DOCUMENTS

| | | |
|---|---|---|
| 57-154496 | 9/1982 | (JP) . |
| 57-187590 | 11/1982 | (JP) . |
| 57-187591 | 11/1982 | (JP) . |
| 57-187593 | 11/1982 | (JP) . |
| 60-40624 | 10/1987 | (JP) . |
| 62-40622 | 10/1987 | (JP) . |
| 5-64690 | 3/1993 | (JP) . |
| 5-35196 | 5/1993 | (JP) . |
| 6-26994 | 4/1994 | (JP) . |
| 6-31796 | 4/1994 | (JP) . |

OTHER PUBLICATIONS

"Abstract of Japan," Appln. No. 3–255782, Laid–Open Patent No. 5–64690 (in English).

* cited by examiner

*Primary Examiner*—Jacob K. Ackun
*Assistant Examiner*—Jeffrey D. Carlson
(74) *Attorney, Agent, or Firm*—Dickstein Shapiro Morin & Oshinsky, LLP

(57) ABSTRACT

The present invention provides a running toy system including a rechargeable running toy which can be charged in a short time and which can run at high speed. A direct current motor 14 is mounted on the center of a chassis 11, and the rotary shaft of the motor is connected to rear drive wheels 12 of a rechargeable running toy. The direct current motor 14 is enclosed with a cover 16. A rechargeable condenser 18 is mounted on the cover 16. The whole chassis 11 is covered with a body cover 20. The direct current motor 14 and the condenser 18 are electrically connected to each other by connection fixtures 22. The ends of the connection fixtures are exposed on the underside of the chassis 11 as charging terminals 24. A voltage is applied to the charging terminals 24 to charge the condenser 18.

6 Claims, 21 Drawing Sheets

RUNNING TOY SYSTEM

This application is a continuation, of application Ser. No. 08/441,317 filed May 15, 1995, now abandoned.

BACKGROUND OF THE INVENTION

The present invention relates to a running toy system, particularly a rechargeable running toy which runs on charged electric power, a charging device for a rechargeable running toy which charges the rechargeable running toy, and a runway along which a rechargeable running toy runs.

Generally, running toys which run on electric power cells as power sources have been long known as toys which are popular especially among boys. However, the usual cells must be frequently replaced by new ones, which is costly. As a countermeasure to this, running toys using rechargeable batteries, such as nickel—cadmium (Ni—Cd) batteries, are noted. They have an advantage that such batteries can be charged from an external power supply to be repeatedly used to run the running toys, which is economic and avoids the inconvenience of replacing batteries.

The conventional rechargeable running toys use as their rechargeable batteries nickel—cadmium batteries, each of which only has a voltage as low as 1.2 V. Accordingly, disadvantageously, high speed is unavailable, and small-sized running toys can not carry batteries with a large reserve capacity.

To secure long running duration and high speed, large-capacity nickel—cadmium batteries or a plurality of nickel—cadmium batteries have to be used, which disadvantageously make running toys heavy and large-sized, and which require long charging times.

Thus, conventional running toys lack speediness and take time to be ready for play-use, which disadvantageously makes them less amusing.

SUMMARY OF THE INVENTION

One object of the present invention is to provide a rechargeable running toy which needs only be charged for a short time and which has high running speed.

Another object of the present invention is to provide a charging device for charging a rechargeable running toy on the run.

Still another object of the present invention is to provide a charging device for charging a rechargeable running toy which can readily charge the running toy in a short time.

More still another object of the present invention is to provide a runway for a rechargeable running toy which can run the rechargeable running toy in various amusing modes.

The above object is achieved by a rechargeable running toy comprising: a running toy body; a motor which propels the running toy body; a condenser which supplies electric power to the motor and which is capable of being charged and discharged; and a charging terminal which is connected to the condenser and which is exposed on the running toy body, for charging the condenser from a charging device.

The above object is achieved by a charging device for use in a rechargeable running toy comprising: a charging electric power source which supplies electric power; a runway along which a rechargeable running toy is to run; and an electric power supply rail which is connected to the charging electric power source and which is brought into contact with a charging terminal of the rechargeable running toy running along the runway.

The above object is achieved by a rechargeable running toy charged by the charging device, the rechargeable running toy comprising: a running toy body; a motor which propels the running toy body; a condenser which supplies electric power to the motor and which is capable of being charged and discharged; and a charging terminal which is connected to the condenser and which is exposed on the running toy body, for charging the condenser through the electric power supply rail from the charging device.

The above object is achieved by a runway for a rechargeable running toy along which the rechargeable running toy runs, the runway comprising: a charging device for use in the rechargeable running toy having an electric power supply rail which is provided at a predetermined position of the runway and which is brought into contact with a charging terminal of the rechargeable running toy running along the runway, and a charging electric power source which supplies electric power to the electric power supply.

The above object is achieved by a runway for a rechargeable running toy along which the rechargeable running toy runs, the runway comprising: a discharge unit which is brought into contact with the charging terminal of the rechargeable running toy to discharge electric power charged to the condenser of the rechargeable running toy; and obstacle means which intermittently exposes the discharge unit to hinder the run of the rechargeable running toy.

The above object is achieved by a runway for a rechargeable running toy along which the rechargeable running toy runs, the runway comprising: a rotary trap which is provided at a predetermined position of the runway and which has an inside surface divided in a plurality of regions; and driving means which rotates the rotary trap, whereby a run state of the rechargeable running toy changes depending on the inside surface of the rotary trap.

The above object is achieved by a runway for a rechargeable running toy, further comprising: detecting means which is provided at a predetermined position of the runway and which detects the running toy passing; and counting means which counts the running toys passing at the predetermined position.

The above object is achieved by a charging device for use in a rechargeable running toy comprising: a charging electric power source which supplies electric power; a mount unit on which a rechargeable running toy is to be mounted; an electric power supply terminal which is connected to the charging electric power source and which is brought into contact with a charging terminal of the rechargeable running toy mounted on the mount unit during charge; and moving means which moves the mount unit to idle drive wheels of the rechargeable running toy during charge.

The above object is achieved by a rechargeable running toy charged by the charging device, the rechargeable running toy comprising: a running toy body; a motor which propels the running toy body; a condenser which supplies electric power to the motor and which is capable of being charged and discharged; and a charging terminal which is connected to the condenser and which is exposed on the running toy body, for charging the condenser through the electric power supply terminal from the charging device.

The charging device for use in a rechargeable running toy comprises: a charging electric power source which supplies electric power; a runway along which a rechargeable running toy is to run; and an electric power supply rail which is connected to the charging electric power source and which is brought into contact with charging a terminal of the rechargeable running toy running along the runway, whereby the rechargeable running toy can be charged while running.

The rechargeable running toy charged by the charging device, comprises: a running toy body; a motor which propels the running toy body; a condenser which supplies electric power to the motor and which is capable of being charged and discharged; and a charging terminal which is connected to the condenser and which is exposed on the running toy body, for charging the condenser through the electric power supply rail from the charging device, whereby the rechargeable running toy can be charged in a short time, and can run at high speed.

The runway for a rechargeable running toy along which the rechargeable running toy runs, comprises: a charging device for use in the rechargeable running toy having an electric power supply rail which is provided at a predetermined position of the runway and which is brought into contact with a charging terminal of the rechargeable running toy running along the runway, and a charging electric power source which supplies electric power to the electric power supply, whereby the rechargeable running toy can be run in various amusing modes.

The runway for a rechargeable running toy along which the rechargeable running toy runs, comprises: a discharge unit which is brought into contact with the charging terminal of the rechargeable running toy to discharge electric power charged to the condenser of the rechargeable running toy; and obstacle means which intermittently exposes the discharge unit to hinder the run of the rechargeable running toy, whereby the rechargeable running toy can be run in various amusing modes.

The runway for a rechargeable running toy along which the rechargeable running toy runs, comprises: a rotary trap which is provided at a predetermined position of the runway and which has an inside surface divided in a plurality of regions; and driving means which rotates the rotary trap, whereby the run state of the rechargeable running toy changes depending on the inside surface of the rotary trap, whereby the rechargeable running toy can be run in various amusing modes.

The charging device for use in a rechargeable running toy comprises: a charging electric power source which supplies electric power; a mount unit on which a rechargeable running toy is to be mounted; an electric power supply terminal which is connected to the charging electric power source and which is brought into contact with a charging terminal of the rechargeable running toy mounted on the mount unit during charge; and moving means which moves the mount unit to idle drive wheels of the rechargeable running toy during charge, whereby the rechargeable running toy can be readily charged in a short time.

The rechargeable running toy charged by the charging device, comprises: a running toy body; a motor which propels the running toy body; a condenser which supplies electric power to the motor and which is capable of being charged and discharged; and a charging terminal which is connected to the condenser and which is exposed on the running toy body, for charging the condenser through the electric power supply terminal from the charging device, whereby the rechargeable running toy can be charged in a short time, and can run at high speed.

DETAILED DESCRIPTION OF THE INVENTION

1. Rechargeable Running Toy

Figure 2:
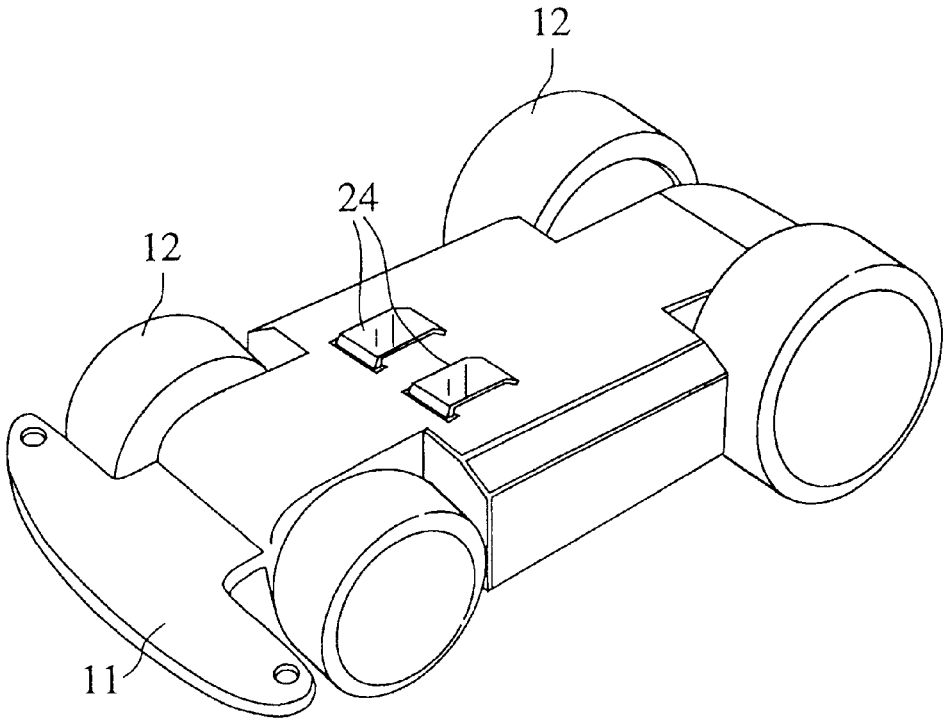
FIG. 2 is a perspective view, as viewed from below, of the rechargeable running toy according to the first embodiment of the present invention.
Figure 3:
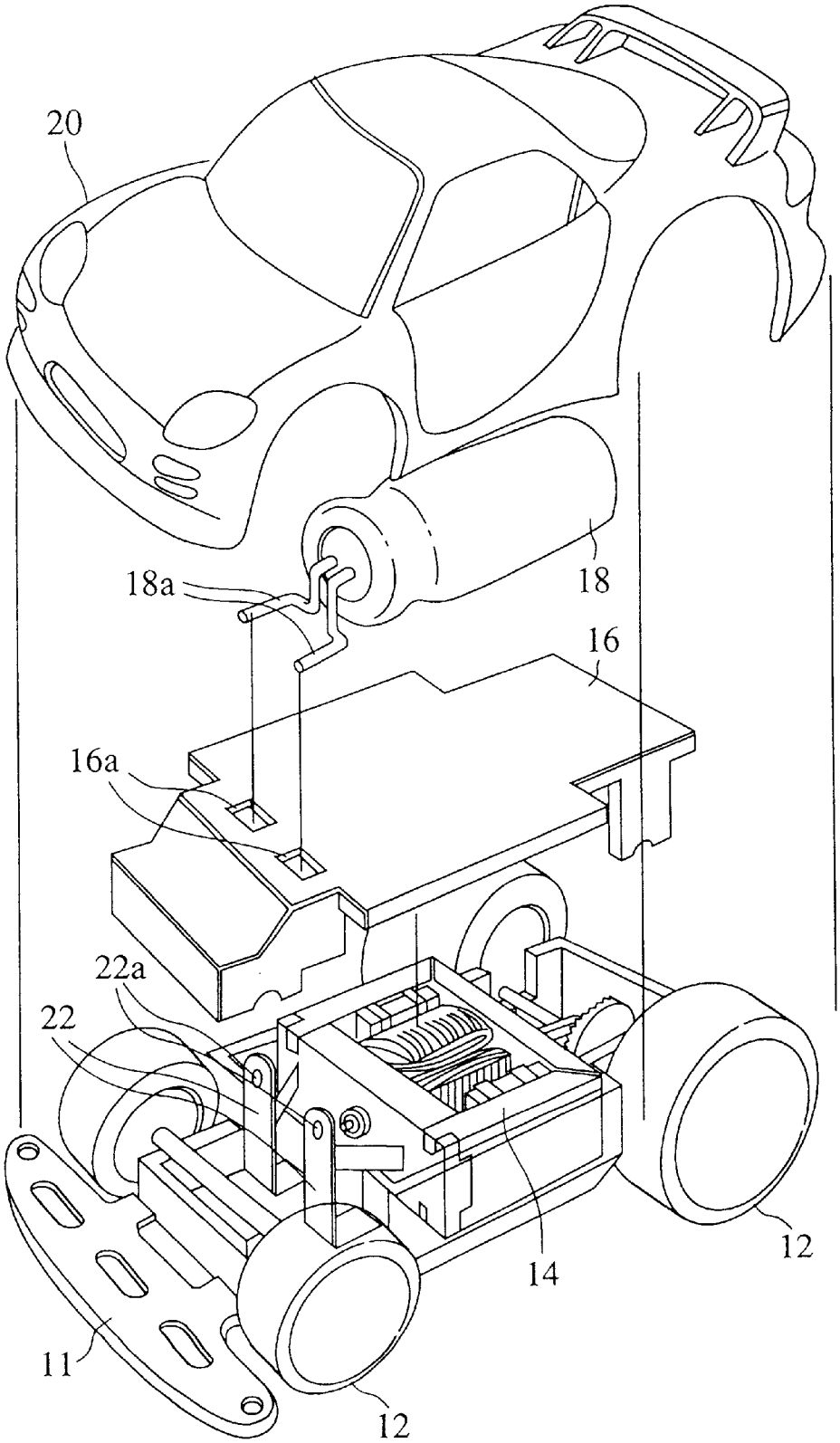
FIG. 3 is a broken perspective view of the rechargeable running toy according to the first embodiment of the present invention.

The rechargeable running toy according to a first embodiment of the present invention will be explained with reference to FIGS. 1 to 3. The rechargeable running toy according to the present embodiment imitates a car.

Figure 1:
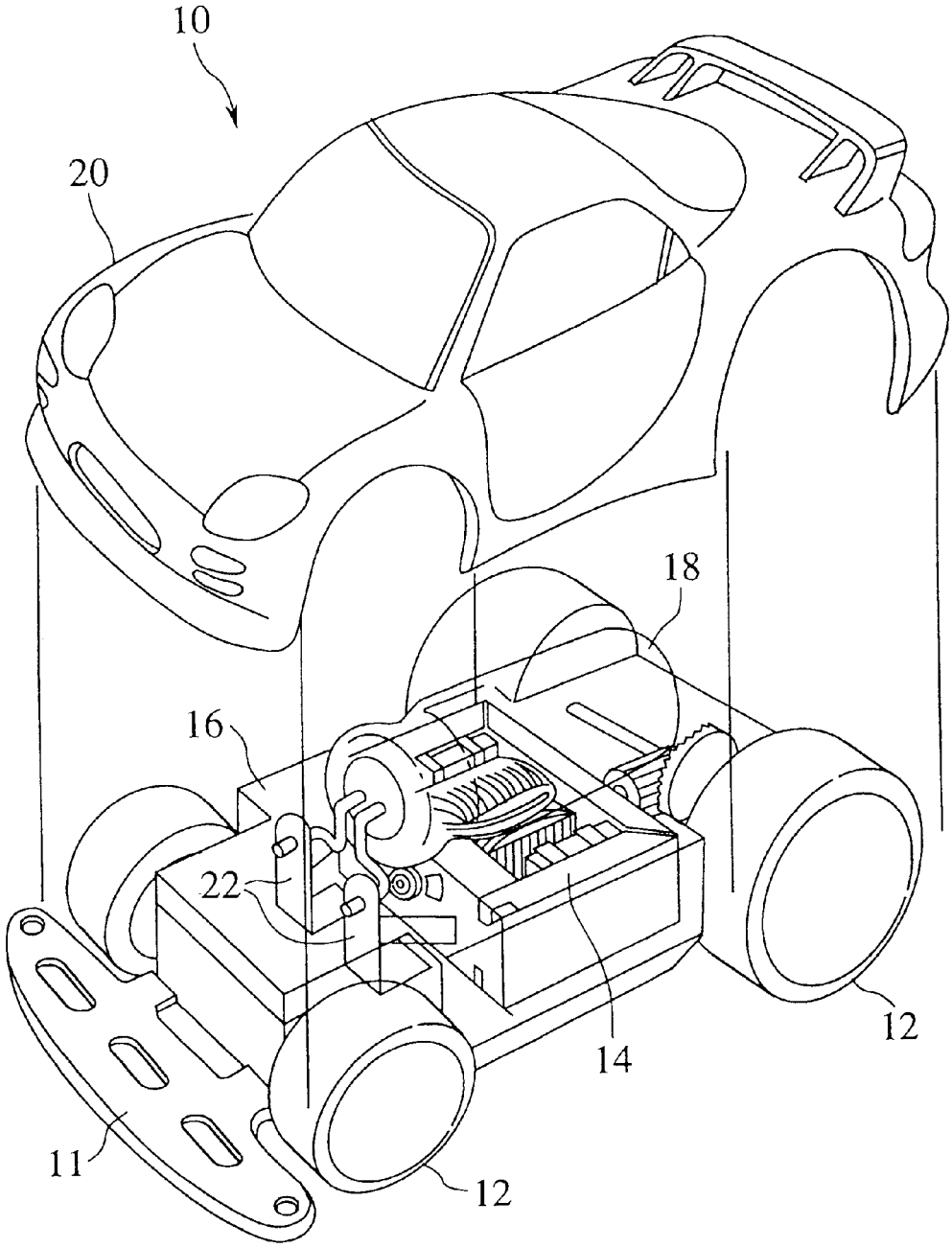
FIG. 1 is a perspective view of the rechargeable running toy according to the first embodiment of the present invention.

As shown in FIG. 1, the rechargeable running toy comprises a chassis 11 as a running toy body, and drive wheels 12 mounted on the chassis 11. A direct current motor 14 is mounted at the center of the chassis 11, and the rotary shaft of the motor 14 is connected to the drive wheels 12. The direct current motor 14 is enclosed with a cover 16. The rechargeable condenser 18 which characterizes the present invention is mounted on the cover 16. The whole chassis 11 is covered with a body cover 20.

The direct current motor 14 and the condenser 18 are electrically connected by connection fixtures 22. As shown in FIG. 2, the ends of the connection fixtures 22 are exposed on the underside of the chassis 11 as charging terminals 24. A voltage is applied to the charging terminals 24 to charge the condenser 18.

The condenser 18 used in the present embodiment is an electric double-layer condenser ("GOLD CAPACITOR" (tradename) by Matsushita Electric Industrial Co. Ltd.) which is a small-sized battery element having an ultra-large capacity in the order of farads (F). This electric double-layer condenser is characterized by having a short charge time, a large capacity and a high discharge voltage (e.g., 3 V) corresponding the charge voltage, and, in addition, by being very small-sized and light. In addition, this electric double layer condenser principally has no polarity, and it is not necessary to take into account the polarity of the charging voltage. When the polarity of the charging voltage is reversed, the polarity of the voltage output from the condenser is also reversed. According to the present embodiment, an innovational rechargeable running toy which has successfully solved the disadvantages of conventional running toys is realized by utilizing the characteristics of such an electric double layer condenser.

In the rechargeable running toy according to the present embodiment, the condenser 18 as the battery element, and the direct current motor 14, are connected to each other directly without a change-over switch or others inserted therebetween. Accordingly, when the condenser 18 is charged, a voltage is applied also to the direct current motor 14 and the drive wheels are unintentionally rotated but without any problem caused to the charge of the condenser 18. This is because the condenser 18 of the present embodiment can be quickly charged in such a short time of 5 to 15 seconds that rotation of the drive wheels during a charge by the direct current motor 14 neither makes the charging time longer nor wastes electric power.

In the present invention, by allowing the drive wheels 12 to be rotated during charge, the drive wheels 12 auditorily confirm the state of charge, based on idling sounds.

Then the method for assembling the rechargeable running toy according to the present embodiment will be explained with reference to FIG. 3.

First, the drive wheels 12 are mounted on the chassis 11. Then the direct current motor 14 is mounted at the center of the chassis 11. Next, the two L-shaped connection fixtures 22 are mounted on the chassis 11 so that the lower end portions thereof are exposed out of the underside of the chassis 11.

Then, the cover 16 for enclosing the direct current motor 14 is mounted so that the upper end portions of the connection fixtures 22 are projected through holes 16*a*. Terminals 18*a* of the condenser 18 are inserted into the holes 22*a* in the upper end portions of the condenser projected out of the holes 16*a*. Thus the condenser is fixed.

Finally the body cover 20 is put on from above, and the rechargeable running toy is completed.

Thus according to the present embodiment, the condenser can be fixedly mounted without the use of solder.

Figure 4:
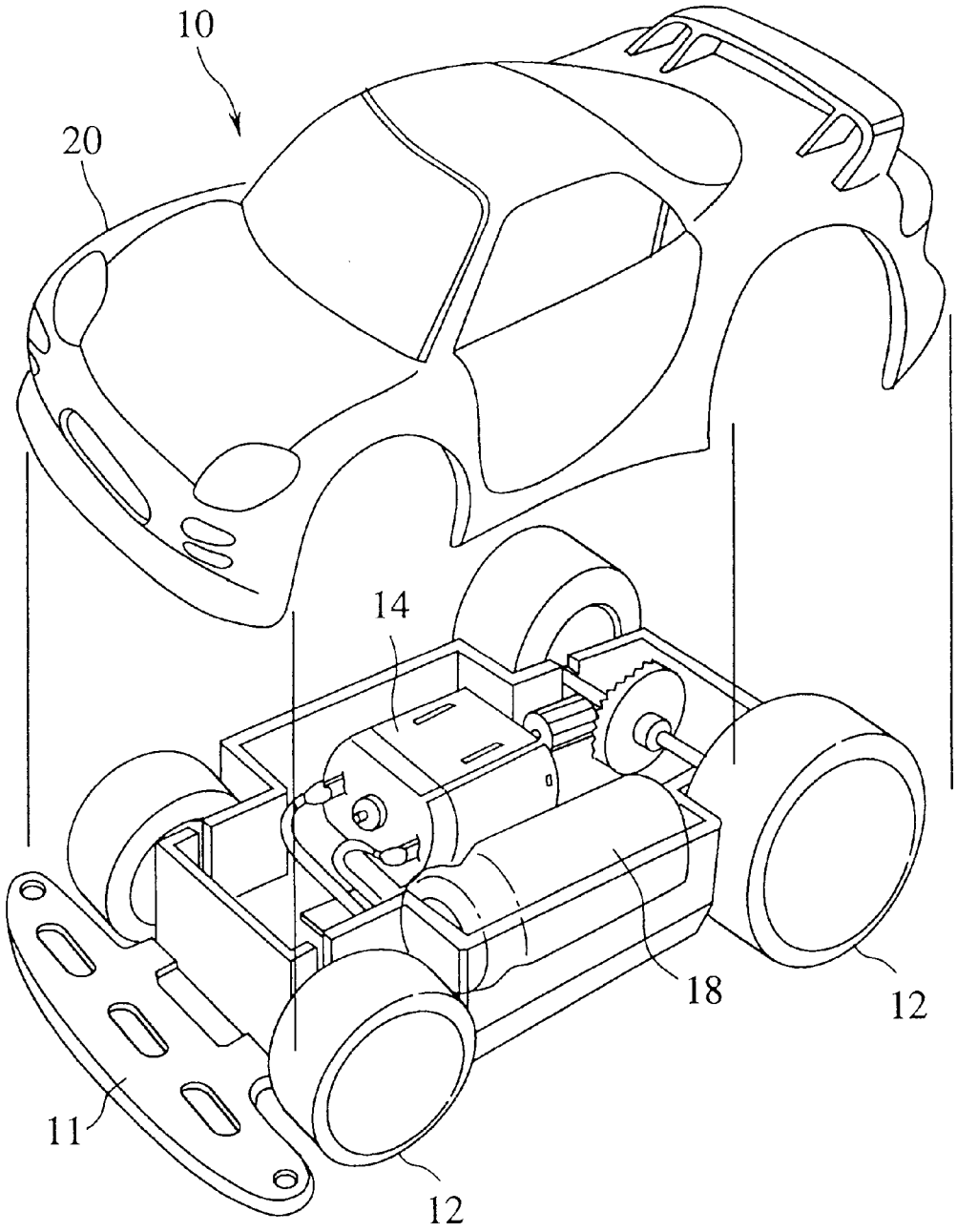
FIG. 4 is a perspective view of the rechargeable running toy according to the second embodiment of the present invention.

The rechargeable running toy according to a second embodiment of the present invention will be explained with reference to FIG. 4. Members of the rechargeable running toy according to the present embodiment common with the first embodiment are represented by common reference numerals so as not to repeat their explanation.

The rechargeable running toy according to the present embodiment includes a small-sized direct current motor 14, and a small-sized condenser 18 so as to be smaller-sized.

The direct current motor 14 and the condenser 18 are mounted on a chassis 11 side by side. In the present embodiment as well, the lower end portions of connection fixtures 22 are exposed as charge terminals 24 on the underside of the chassis 11. The direct current motor 14 and the condenser 18 are electrically connected by the connection fixtures 22.

2. Running Toy System (1)

The running toy system according to the first embodiment of the present invention will be explained with reference to FIGS. 5 to 14.

Figure 5:
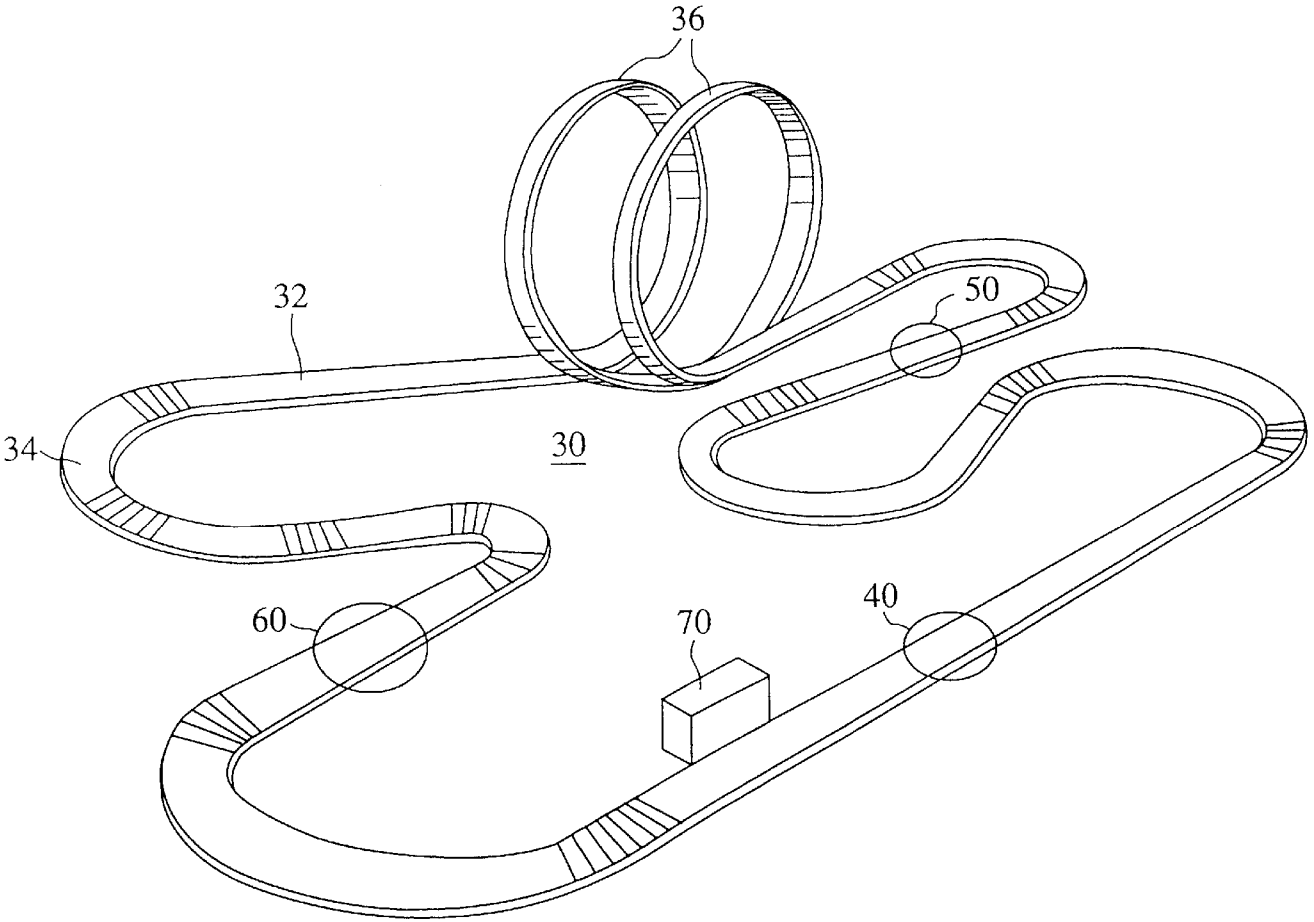
FIG. 5 is a perspective view of the running toy system according to the first embodiment of the present invention.

As shown in FIG. 5, the running toy system according to the first embodiment is in the form of a circuit runway 30. The runway 30 is basically a combination of linear runways 32, curved runways 34, and a looped runway 36. Charging means 40 which charges the rechargeable running toy is provided at the run starting position of the runway 30. To give the runway variety, obstacle runways 50, 60 are included. Counting means 70 is provided for counting a number of circuits of the rechargeable running toy.

The charging means 40 will be explained with reference to FIG. 6.

The charging means 40 is provided in the runway 30. The charging means 40 includes a charging runway 41 and a battery box 43. The charging runway 41 is inserted in the runway 30 and has a vertically movable electric power supply rail 42 provided at the center thereof. The battery box 43 is provided on a side of the charging runway 41 as a charging electric source for supplying electric power. The battery box 43 can accommodate, e.g., 2 to 4 batteries (not shown). Electric power is supplied from the cells in the battery box 43 to the electric power supply rail 42.

Figure 6A:
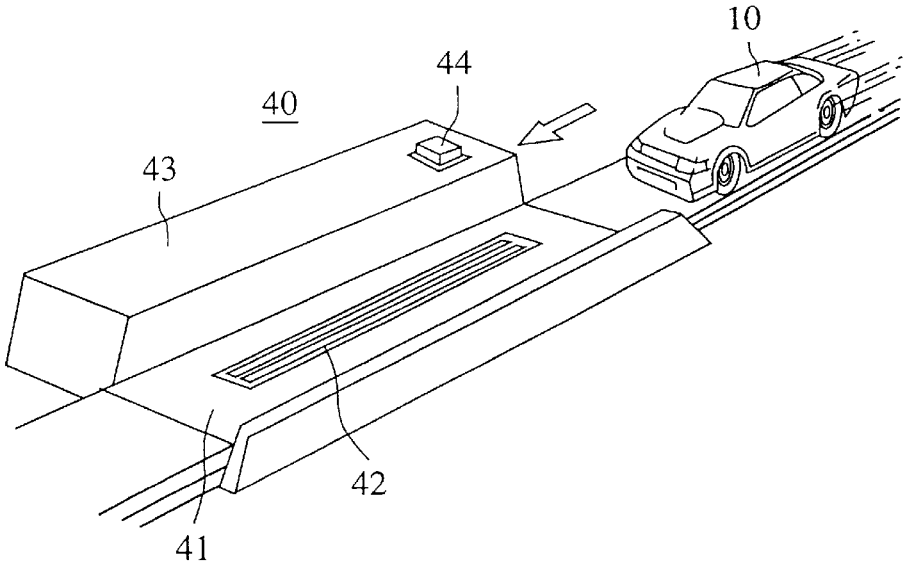
FIGS. 6A and 6B are perspective views of the charging means of the running toy system according to the first embodiment of the present invention.
Figure 6B:
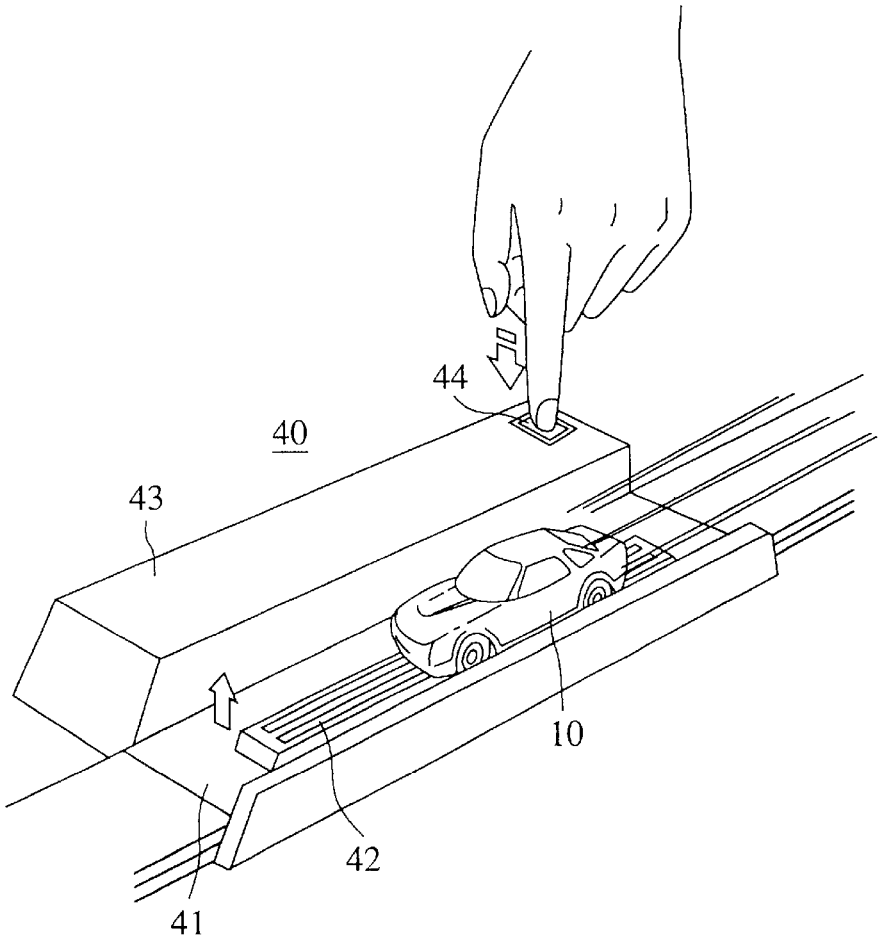

A charge switch 44 is provided on the upper side of the battery box 43. The charge switch 44 is pressed down to project the electric power supply rail 42 from the center of the charging runway 41. The charge switch 44 is pressed down in timing with the rechargeable running toy 10 on the run as shown in FIG. 6A, and as shown in FIG. 6B, the electric power supply rail 42 is projected out from the charging runway 41. While the rechargeable running toy 10 is running on the charging runway 41, the projected electric power rail 42 and the charging terminals 24 of the rechargeable running toy 10 contact each other, and the condenser 18 is charged. The thus-charged toy 10 circulates along the runway 30.

When the polarity of the voltage supplied by the electric power rail 42 is reversed by a switch (not shown) for example, the condenser 18 of the rechargeable running toy 10 running along the charging rail 41 discharges and is charged with an opposite polarity, and the rechargeable running toy 10 running forward stops abruptly and then runs backward at high speed.

Figure 7:
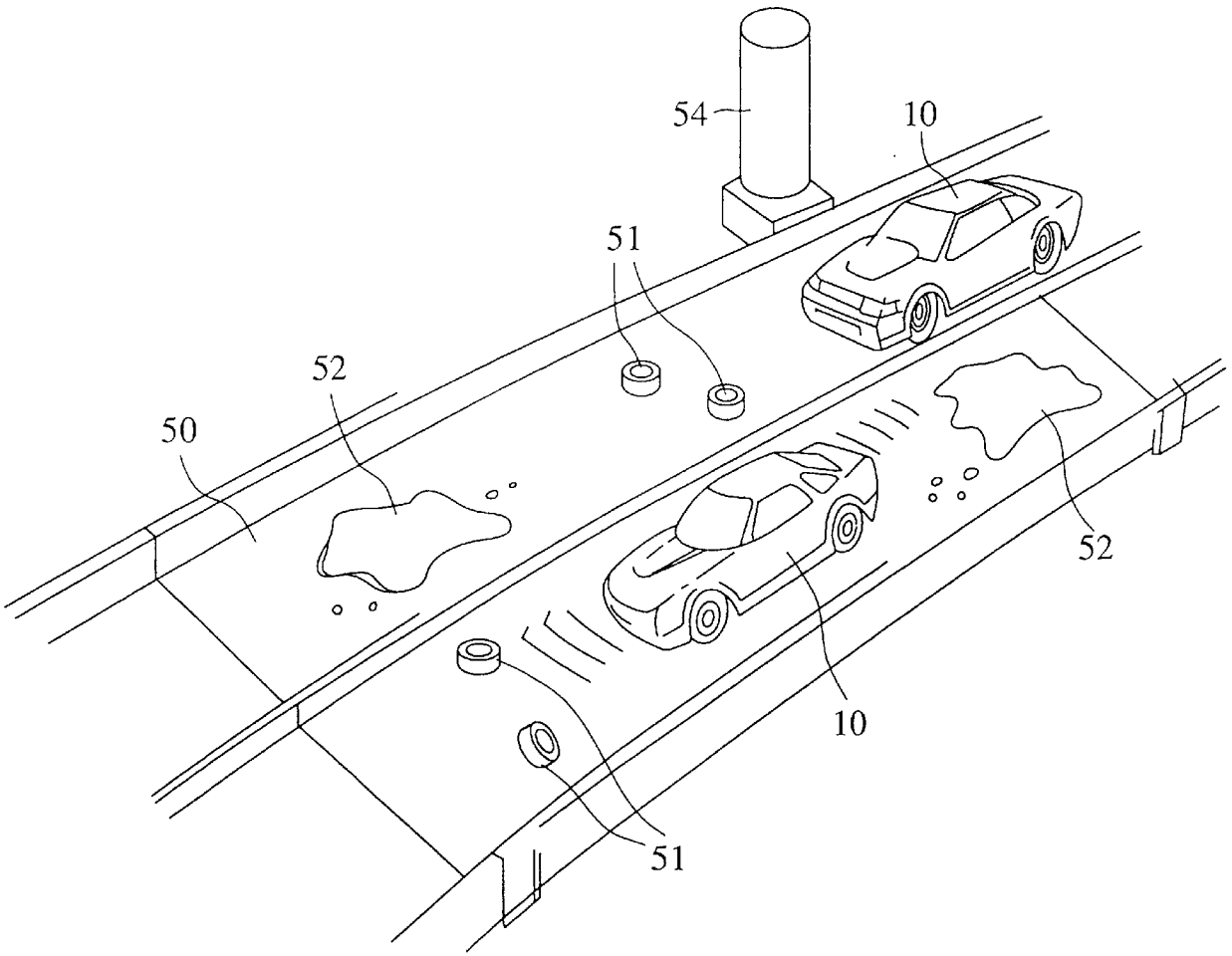
FIG. 7 is a perspective view of the obstacle runway of the running toy system according to the first embodiment of the present invention.

Then the obstacle runway 50 will be explained with reference to FIG. 7.

An obstacle 51 is provided on the obstacle runway 50 for obstructing the run of the rechargeable running toy 10. In the obstacle runway 50 there is provided a discharge part 52 which is moved up and down. The discharge part 52 imitates oil on an actual road. A controller 54 which is an obstructing means intermittently moves the discharge part 52 up and down to obstruct the run of the discharge-type running toy 10.

When the rechargeable running toy 10 runs over the discharge part 52 projected upward, the charging terminals 24 of the toy 10 contact the discharge part 52, and electric power of the condenser 18 is discharged. Thus the rechargeable running toy 10 rapidly loses energy.

When the toy 10 runs over the discharge part 52 retracted inside the obstacle runway 50, the charging terminals 24 of the rechargeable running toy 10 do not contact the discharge part 52, and the condenser 18 keeps its electric power.

Figure 8:
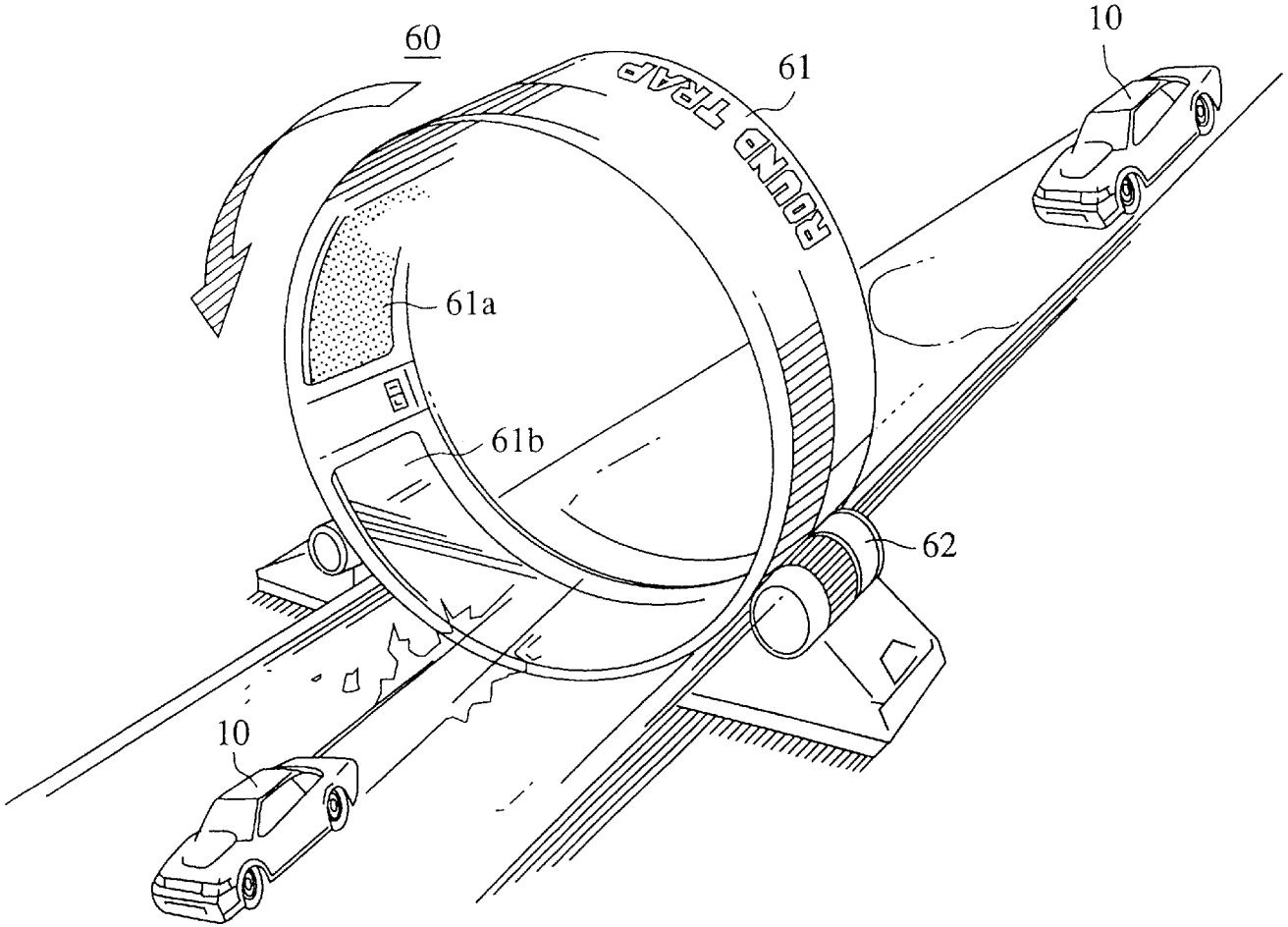
FIG. 8 is a perspective view of another obstacle runway of the running toy system according to the first embodiment of the present invention.

Then, a different obstacle runway 60 will be explained with reference to FIG. 8.

In an obstacle runway 60 there is provided a rotary trap 61 in the runway 30. The rotary trap 61 is always rotated by drive means 62. The inside surface of the rotary trap 61 is divided in a plurality of regions, such as a rough runway surface region 61*a,* a discharge runway surface region 61*b* and a normal runway surface region (not shown), etc.

The run states, such as the speed, of the rechargeable running toy 10 on the run changes depending on runway surfaces of the obstacle runway 60 through which the toy 10 is running. While the rechargeable running toy 10 is running along the rough runway surface region 61*a*, the toy 10 is caught by the rough runway surface, and its run state is changed. While the toy 10 is running along the discharge runway surface region 61*b,* the charging terminals 24 of the toy 10 contact the discharge part 52, and electric power of the condenser 18 is discharged, and the rechargeable running toy 10 quickly loses its energy. While the rechargeable running toy 10 is luckily running along the normal runway surface region, the toy 10 can maintain its run state without any hindrance.

Figure 9:
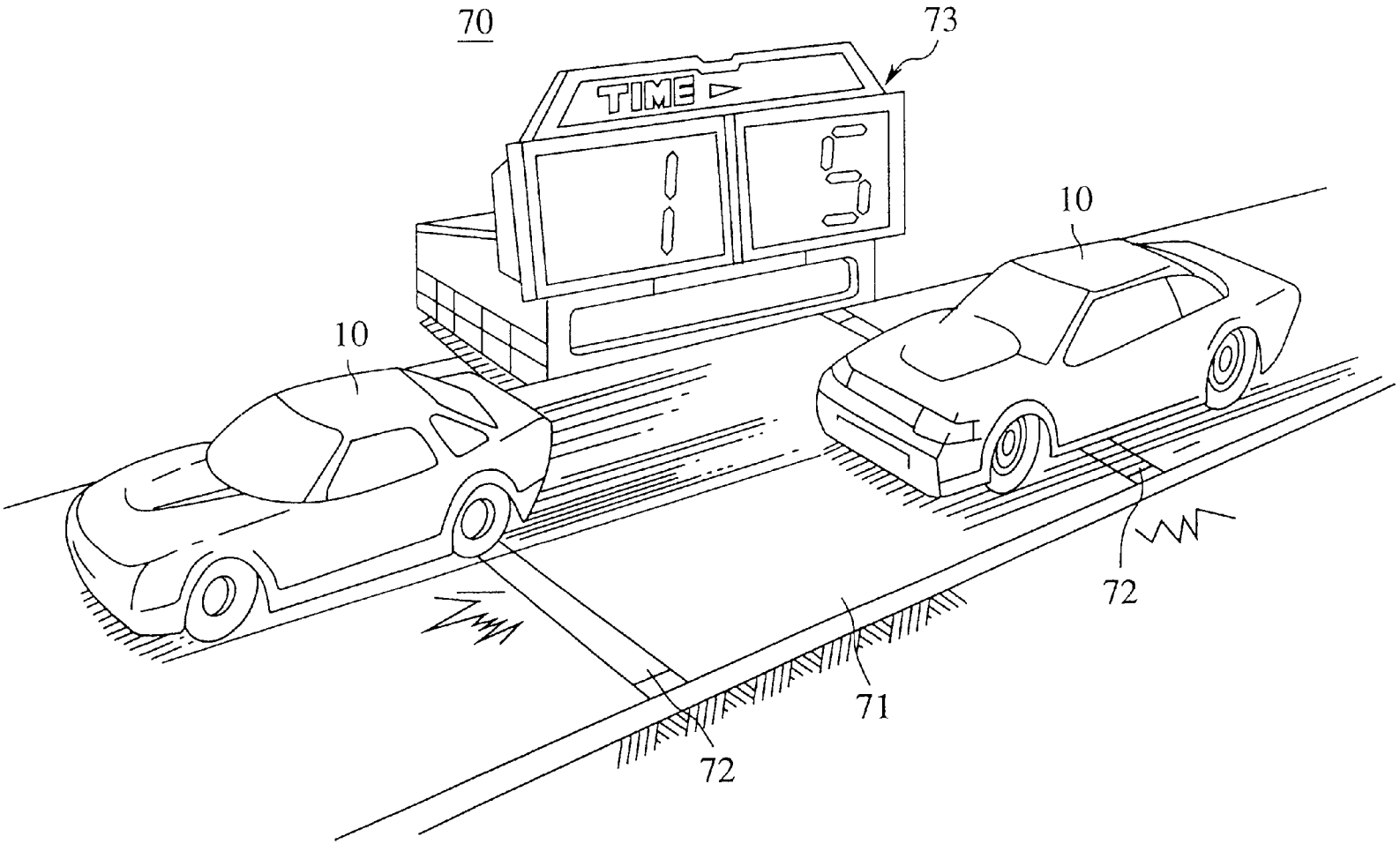
FIG. 9 is a perspective view of the counting means of the running toy system according to the first embodiment of the present invention.

Next, the counting means 70 will be explained with reference to FIG. 9.

The counting means 70 includes a counting runway 71. The counting runway 71 has a sensor 72. Different colored tape (not shown) is applied in advance to the underside of each racing rechargeable running toy 10. When the racing toys 10 run along the counting runway 71, the color of the colored tape of the racing toys 10 is detected by the sensor 72 to count numbers of circuits of the respective racing toys 10. The numbers of circuits of the respective racing toys 10 are displayed on a display unit 73.

Thus, according to the present embodiment, rechargeable running toys 10 circulate along the circuit of the runway, running over obstacles of the obstacle runways, competing for the highest number of circuits as counted by the counting means. Thus a thrilling and amusing circuit game can be enjoyed.

2.1 Charging Means (1)

Another example of the charging means which is applicable to the running toy system according to the present embodiment will be explained with reference to FIGS. 10 to 12.

In the above-described charging means 40, the rechargeable running toy 10 is charged while running, but in the charging means according to the present example, the rechargeable running toy 10 is paused for charge. This is for ensuring a large charge of electric power.

As shown in FIG. 10, a charging runway 81 includes a stopper 82, and a mounting plate 83 on which the rear wheels of the rechargeable running toy 10 are to be mounted. The stopper 82 and the mounting plate 83 are moved by a charge lever 84 for charge.

A battery box 89 is provided, as an electric power source, on a side of the charging runway 81 which supplies electric power. The battery box 89 accommodates 2 to 4 batteries (not shown). Electric power is supplied to electric power supply terminals 85 from the cells accommodated in the battery box 89.

Figure 10A:
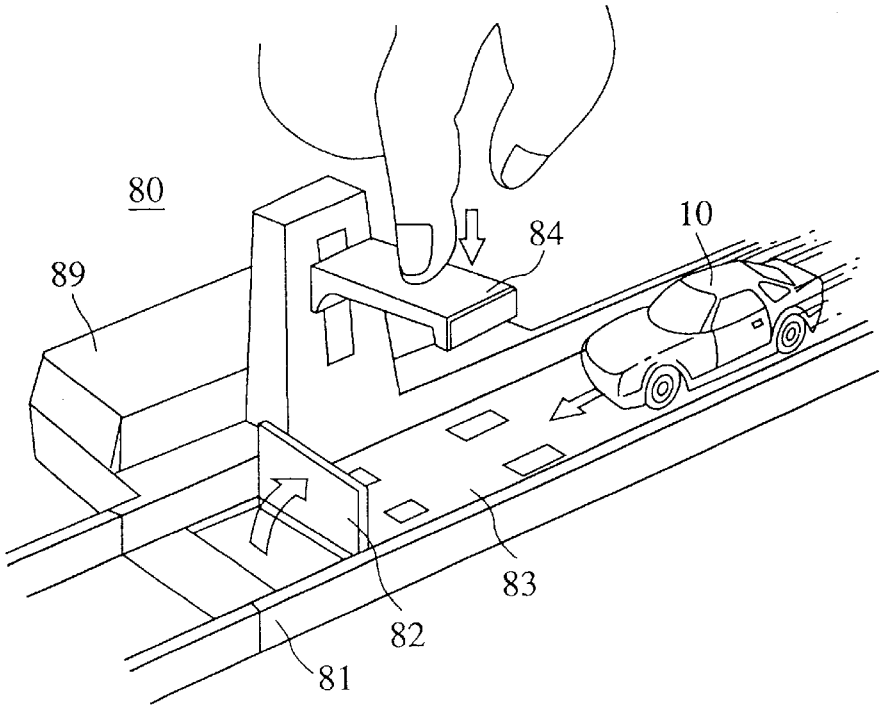
FIGS. 10A and 10B are views of an example of the charging means of the running toy system according to the first embodiment of the present invention.
Figure 10B:
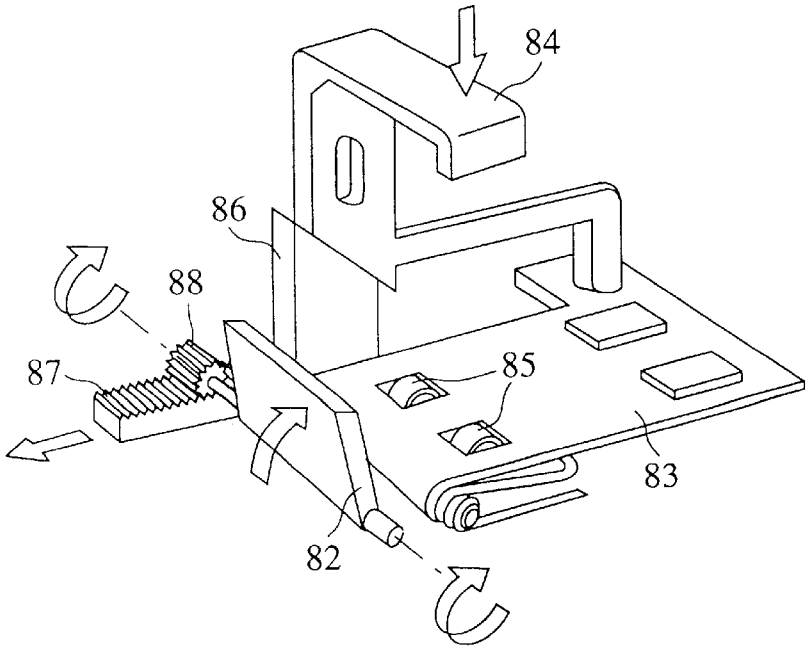

As shown in FIG. 10A, when the charge lever 84 is pressed down to charge the rechargeable running toy 10, the stopper 82 is raised. That is, as shown in FIG. 10B, a slide lever 86 is pushed forward causing a pinion 88 in mesh with a rack 87 to rotate, whereby the stopper is raised. The rechargeable running toy 10 stops and rests against the stopper 82 and is paused at the charging position.

Figure 11A:
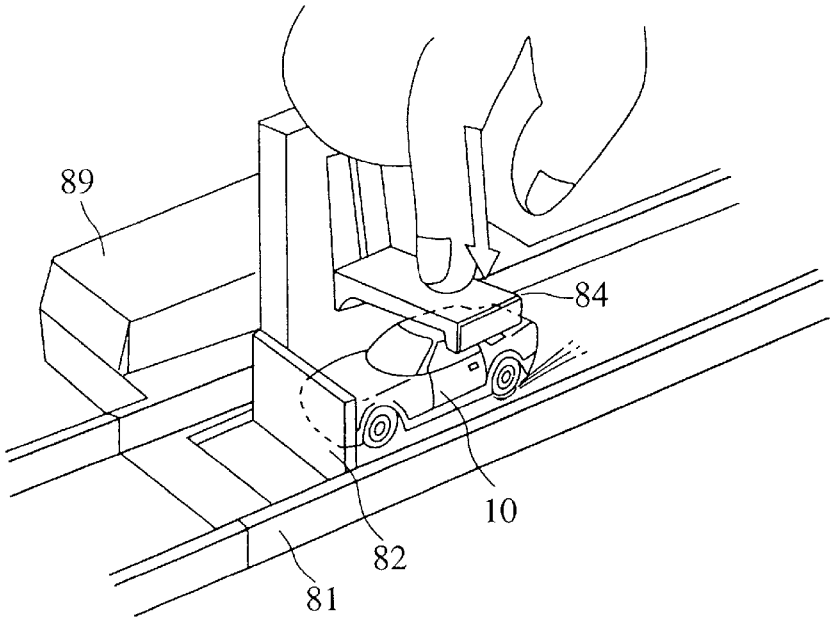
FIGS. 11A to 11C are views of another example of the charging means of the running toy system according to the first embodiment of the present invention.
Figure 11B:
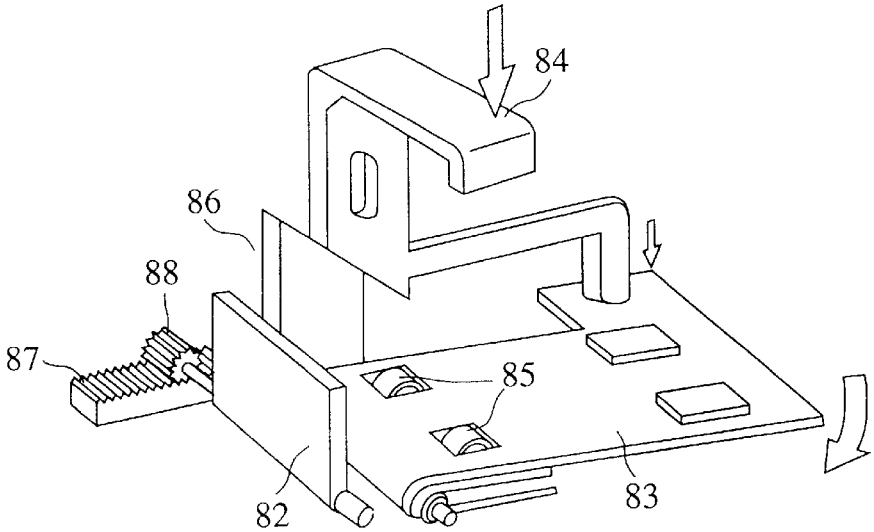
Figure 11C:
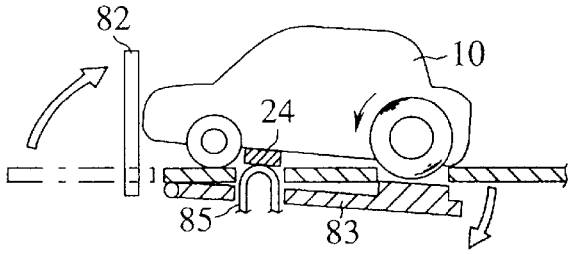

Then as shown in FIG. 11A, the charge lever 82 is further pressed down to press down the roof of the rechargeable running toy 10 paused at the charging position. Then as shown in FIG. 11B, the mounting plate 83 which supports the rear wheels of the toy 10 is pushed down to lower the toy 10, and as shown in FIG. 11C, the charging terminals 24 of the rechargeable running toy 10 are brought into contact with an electric power supplying terminal 85 to charge the condenser.

When the condenser 18 is charged, the rear drive wheels 12 are rotated by the direct current motor 14. However, as shown in FIG. 11C, because of a gap between the mounting plate 83 and the drive wheels 12, the drive wheels 12 are idled, and the toy 10 does not run forward. The player listens to sounds of the idling drive wheels to auditorily confirm the state of charge.

Figure 12:
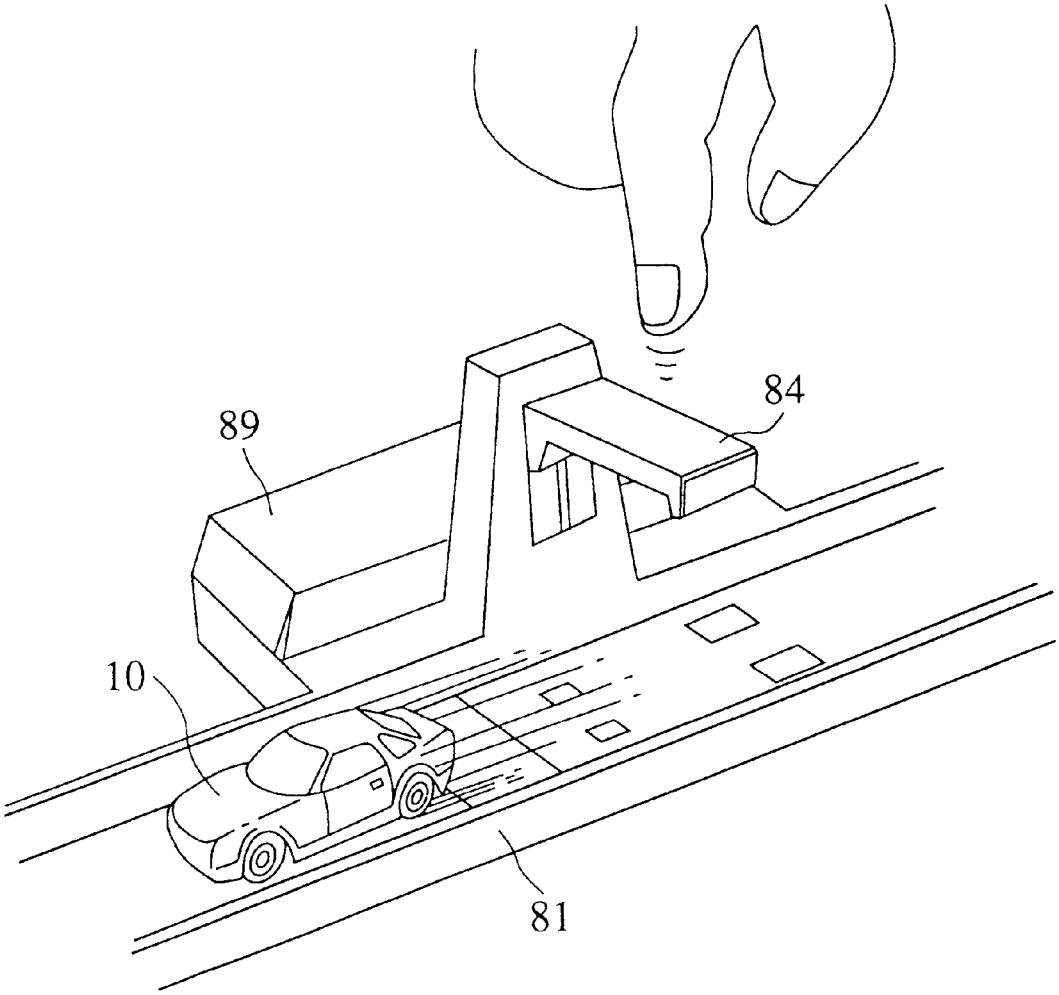
FIG. 12 is a view of a further example of the charging means of the running toy system according to the first embodiment of the present invention.

Next, as shown in FIG. 12, when the charge lever 84 is released, the mounting plate 83 is returned to its original position, and the stopper 82 falls forward to its original position. And the rechargeable running toy 10 vigorously resumes running forward.

Thus according to the present example, the charge lever is simply pressed down to charge the rechargeable running toy with much electric power without failure.

2.2 Charging Means (2)

Further, another charging means which is applicable to the rechargeable running toy according to the present embodiment will be explained with reference to FIGS. 13 and 14.

The charging means 80 according to the above-described example charges the rechargeable running toy 10 by simply pressing down the charge lever 84, but the charging means according to the present example has a further simplified driving mechanism.

Figure 13A:
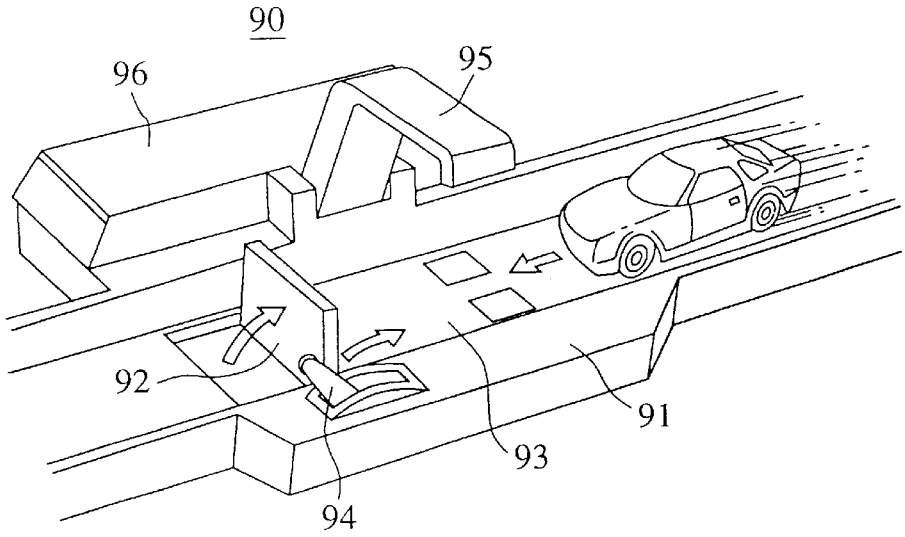
FIGS. 13A to 13C are views of a different example of the charging means of the running toy system according to the first embodiment of the present invention.
Figure 13B:
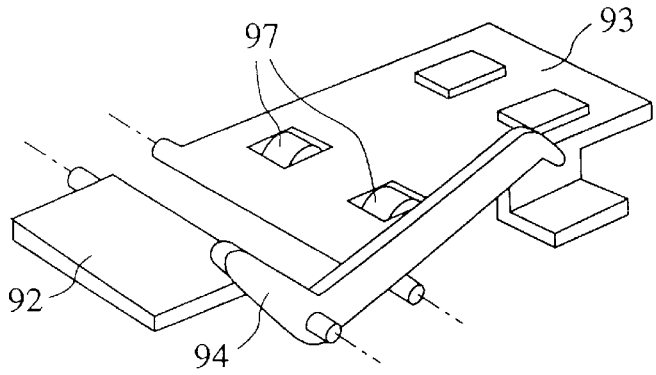
Figure 13C:
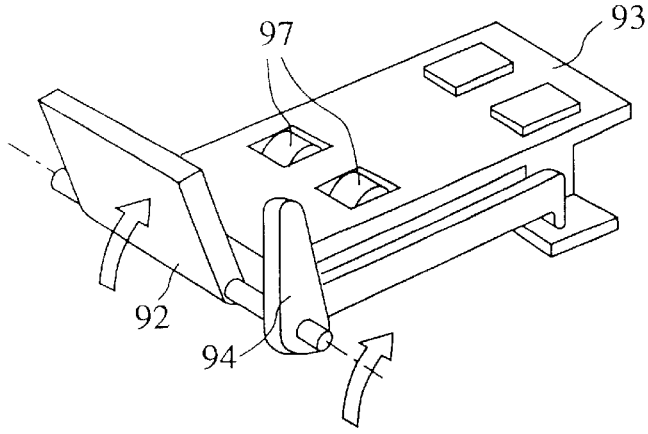

As shown in FIG. 13, a charging runway 91 includes a stopper 92 which pauses the rechargeable running toy 10, and a mounting plate 93 on which the rear drive wheels of the toy 10 are to be mounted. The stopper 92 and the mounting plate 93 are moved by a stopper lever 94 and a charge lever 95 for charge.

A battery box 96 as a charging electric power source is provided on a side of the charging runway 91. The battery box 96 accommodates, e.g., 2 to 4 batteries (not shown). Electric power is supplied to electric power charging terminals 97 from the cells accommodated in the battery box 96.

As shown in FIGS. 13B and C, when the stopper lever 94 is turned, the stopper 92 is raised and the rechargeable running toy 10 running forward stops and rests against the stopper 92 to be paused at the charging position.

Figure 14A:
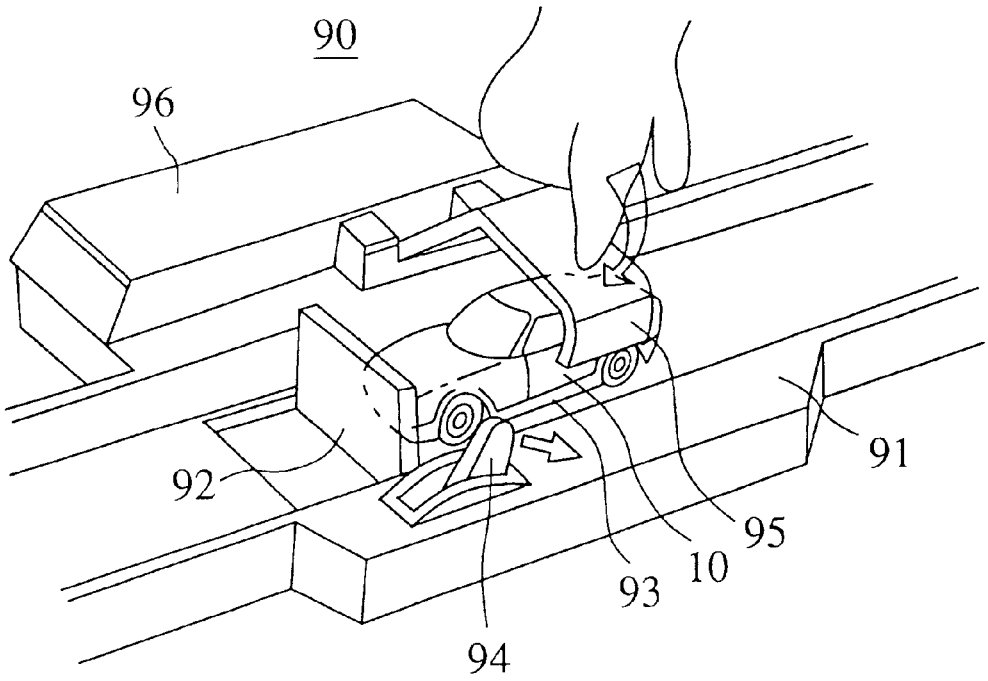
FIGS. 14A and 14B are views of a further different example of the charging means of the running toy system according to the first embodiment of the present invention.
Figure 14B:
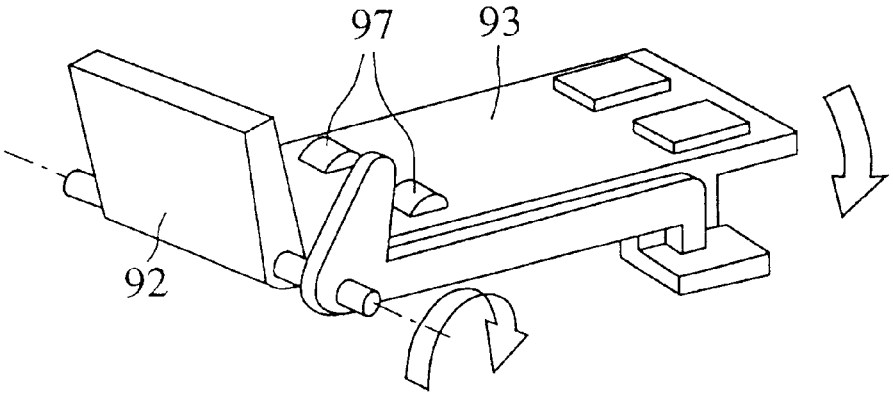

When the stopper lever 94 is further turned, as shown in FIG. 14B, the mounting plate 93 is pressed down. In this state, as shown in FIG. 14A, the charge lever 95 is pressed down to press the roof of the toy 10, whereby the charging terminals 24 of the toy 10 are strongly pressed against the electric power charging terminals 97, and the condenser 18 is charged.

Thus, according to the present example, although the stopper lever and the charge lever have to be operated, the rechargeable running toy can be charged without failure by the simpler and inexpensive mechanism.

3. Running Toy System (2)

The running toy system according to a second embodiment of the present invention will be explained with reference to FIGS. 15 to 18.

Figure 15:
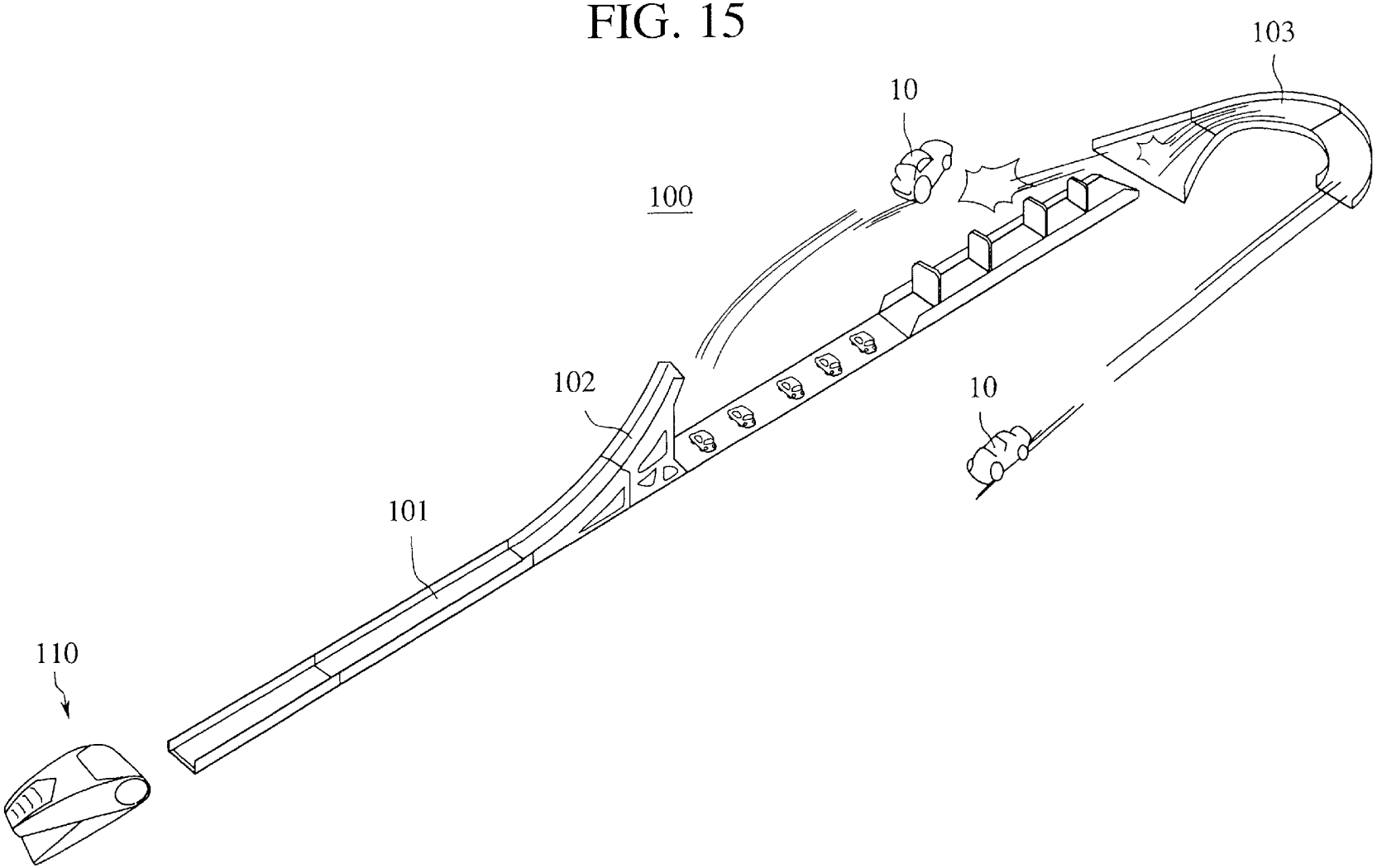
FIG. 15 is a perspective view of the running toy system according to the second embodiment of the present invention.

As shown in FIG. 15, the running toy system according to the present embodiment is in the form of a runway 100 for jumping. The runway 100 includes a linear runway 101, a jumping runway 102 and a recovery runway 103. Charging means 110 is provided before the linear runway 101.

The rechargeable running toy 10 is charged by the charging means 110 to run along the linear runway 101. The rechargeable running toy 10 jumps from the jumping runway 102. Rechargeable running toys compete in jump distances. The rechargeable running toys 10 which have jumped return to the players along the recovery runway 103.

The charging means 110 will be explained with reference to FIG. 16.

As shown in FIG. 16, the charging means 110 includes a mount 112 on which the rechargeable running toy 10 is to be placed. A charge cover 114 is provided above the mount 112. A battery box 116 as a charging electric power source for supplying electric power is provided on a side of the mount 112. The battery box 116 accommodates, e.g., 2 to 4 batteries (not shown).

Figure 16A:
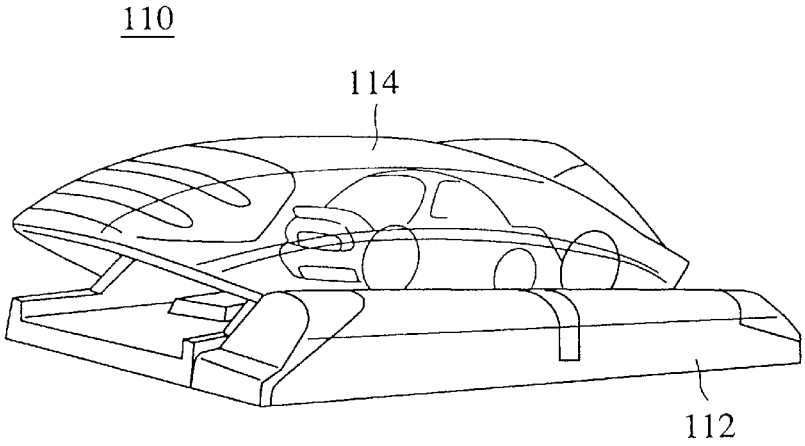
FIGS. 16A and 16B are perspective views of the charging means of the running toy system according to the second embodiment of the present invention.
Figure 16B:
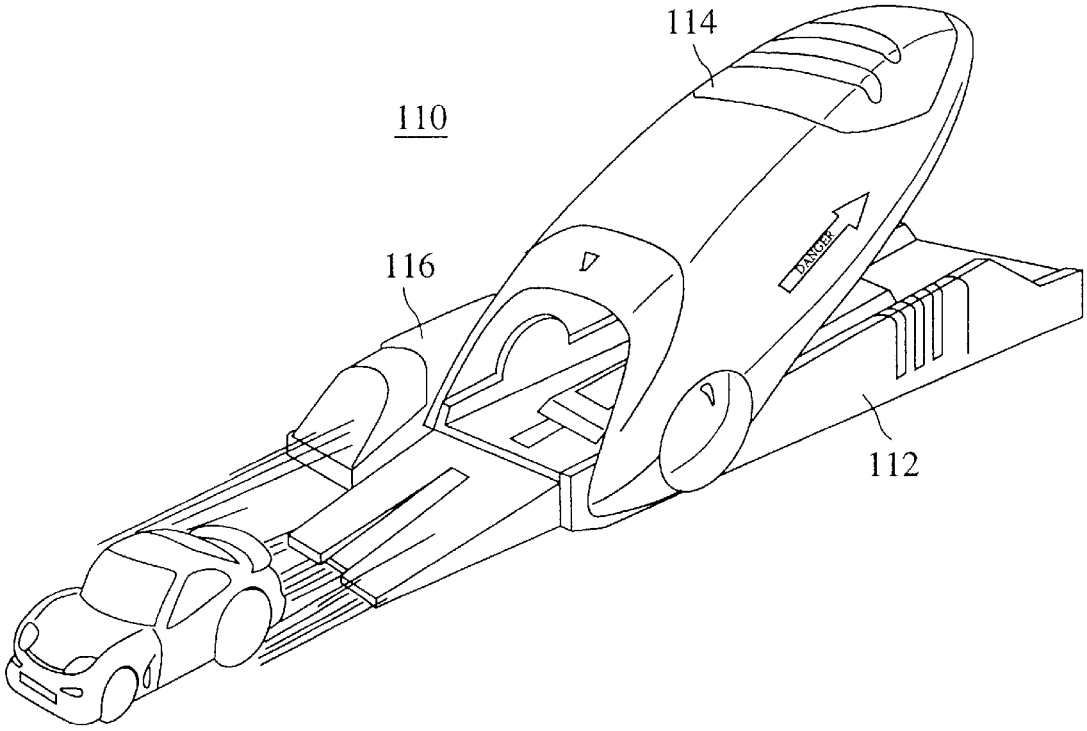

As shown in FIG. 16A, the player places the rechargeable running toy 10 on the mount 112 of the charging means 110, and presses down the charge cover 114, whereby the condenser of the toy 10 mounted on the mount 112 is charged. After charging is completed, the player releases the charge cover 114, whereby, as shown in FIG. 16B, the front of the charging means 110 is opened to permit the rechargeable running toy 10 to vigorously come out of the charging means.

As described above, the condenser 18 of the rechargeable running toy 10 has a higher discharge voltage in accordance with charge voltages. For example, when the condenser 18 is charged with a 6 V charge voltage from four batteries, a discharge voltage is about 4.5 V. When the condenser 18 is charged with 3 V from two batteries, a discharge voltage is about 2.5–3.0 V.

Thus as a charge voltage is higher, a discharge voltage is higher. But higher discharge voltages are not essential. With an about 4.5 V discharge voltage, the drive wheels 12 of the rechargeable running toy 10 are rotated at very high speed, and the toy 10 tries to run at very high speed. But when the runway is slippery, it is often the case that the drive wheels 12 slip, and the toy 10 can not run. In such a case, the rechargeable running toy 10 can run better at low charge voltages. Thus it is preferred to adjust discharge voltage corresponding to conditions of the runway.

In the charging means 110 of the present embodiment, a charge voltage is adjusted by changing a number of cells to be used. To this end, a dummy cell having the shape of the usual cell and having the positive electrode and the negative electrode directly connected to each other is prepared, and is accommodated in the battery box 116 in place of a usual cell. For example, when three cells are used, one dummy cell is placed among the three cells in the battery box 116, whereby a charge voltage can be very easily adjusted.

Figure 17:
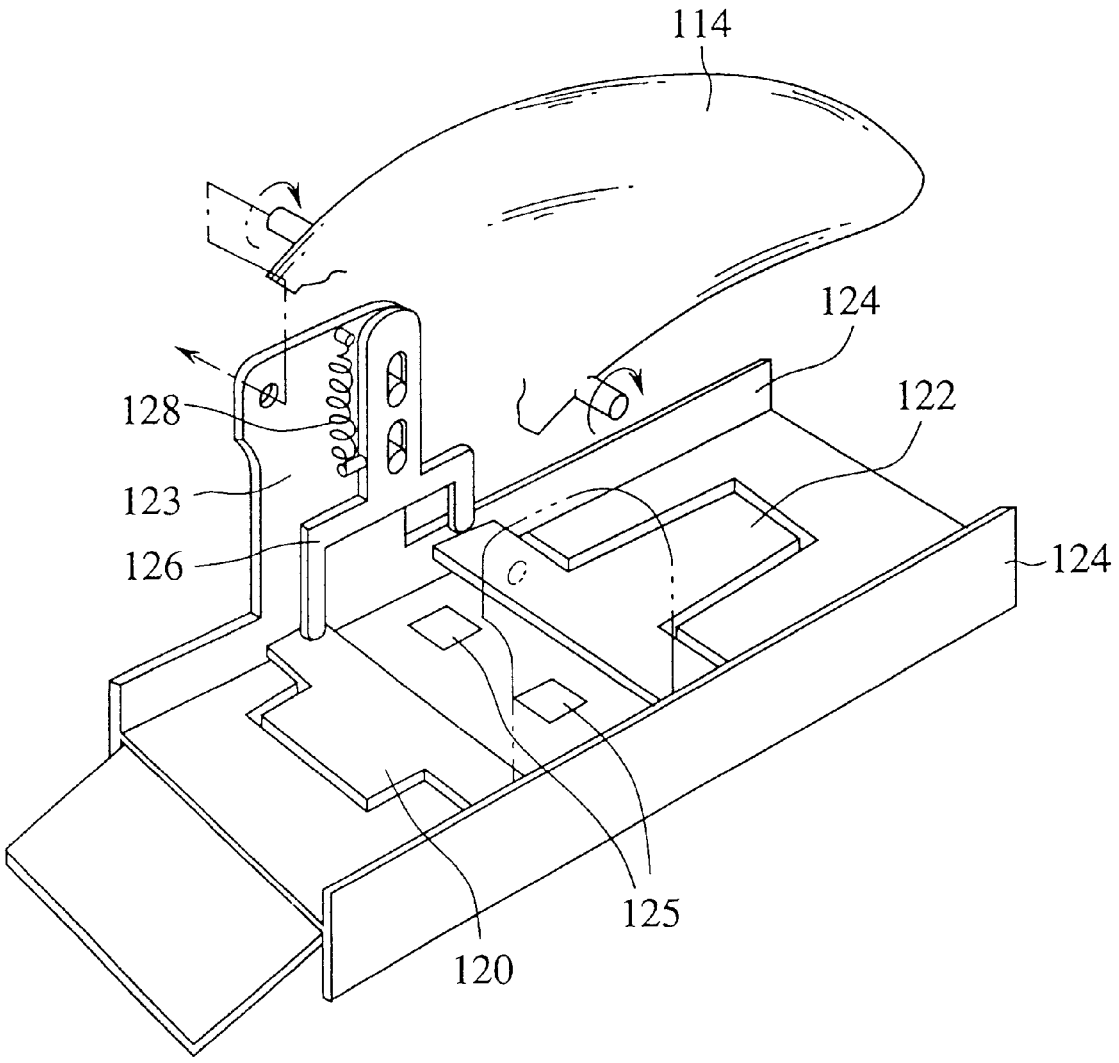
FIG. 17 is a perspective view of the charging means explaining its mechanism according to the running toy system according to the second embodiment of the present invention.

Next, the mechanism of the charging means 110 will be described with reference to FIGS. 16 and 17.

On a mount 112 there are provided a stopper 120, which pauses the rechargeable running toy 10, and a mounting plate 122 on which the toy 10 is to be mounted. The stopper 120 and the mounting plate 122 are swingably mounted between side plates 124 of the mount 122. Electric power supplying terminals 125 for charge are provided between the stopper 120 and the mounting plate 122.

The charge cover 114 has its fulcrum on a support rod 123 fixed to a side plate 124. In accordance with vertical movement of the charge cover 114, a presser plate 126 is vertically moved. The presser plate 126 is normally urged upward by a coil spring 128.

The operation of the charging means 110 will be explained with reference to FIG. 18.

Figure 18A:
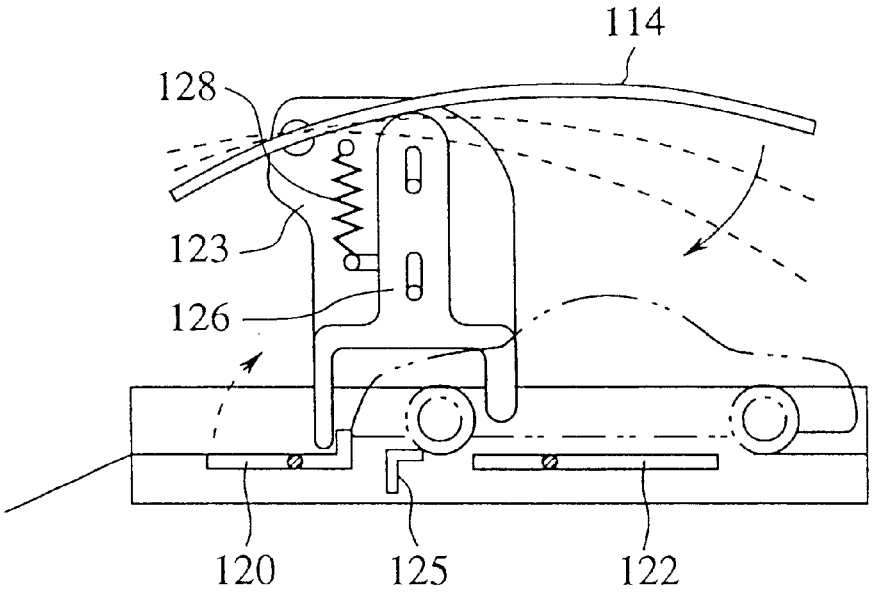
FIGS. 18A and 18B are perspective views of the charging means according to the running toy system according to the second embodiment of the present invention explaining its mechanism.

As shown in FIG. 18A, the rechargeable running toy 10 is placed on the mount 112 of the charging means 110. In this state, the charge cover 114 is pressed down. When the charge cover 114 is pressed down, the presser plate 126 presses down the end of the stopper 120, and the end of the mounting plate 122. The stopper 120 swings on the fulcrum and rises to prohibit the toy 10 from moving forward.

Figure 18B:
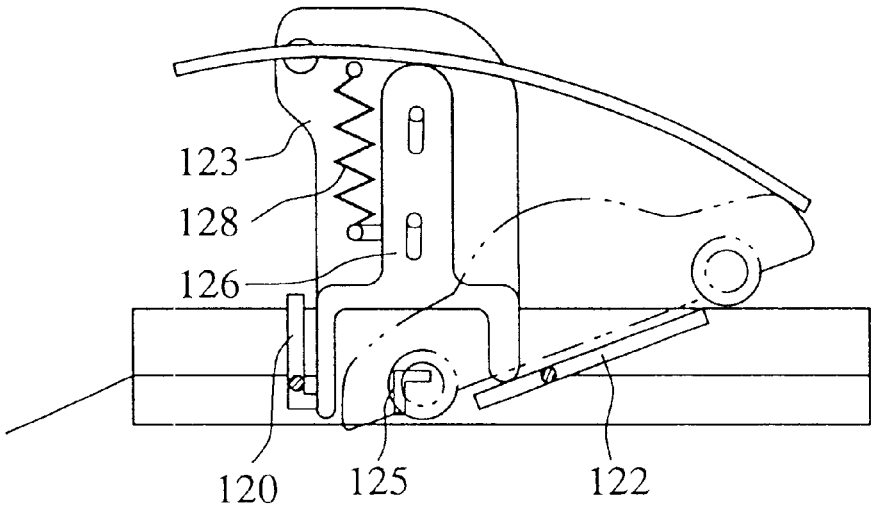

As shown in FIG. 18B, the mounting plate 122 is also swung on the fulcrum and tilts to incline the toy 10 forward. Then the charging terminals 24 of the rechargeable running toy 10 are brought into contact with the electric power supplying terminals 125, and the condenser 18 is charged. The inclined mounting plate 122 keeps the rear of the rechargeable running toy 10 in the air, and the rear drive wheels 12 are idle in the air.

As described above, the state of charge of the condenser 18 is auditorily confirmed by the idling sounds of the drive wheels.

4. Running Toy System (3)

The running toy system according to a third embodiment of the present invention will be explained with reference to FIGS. 19 and 20.

Figure 19:
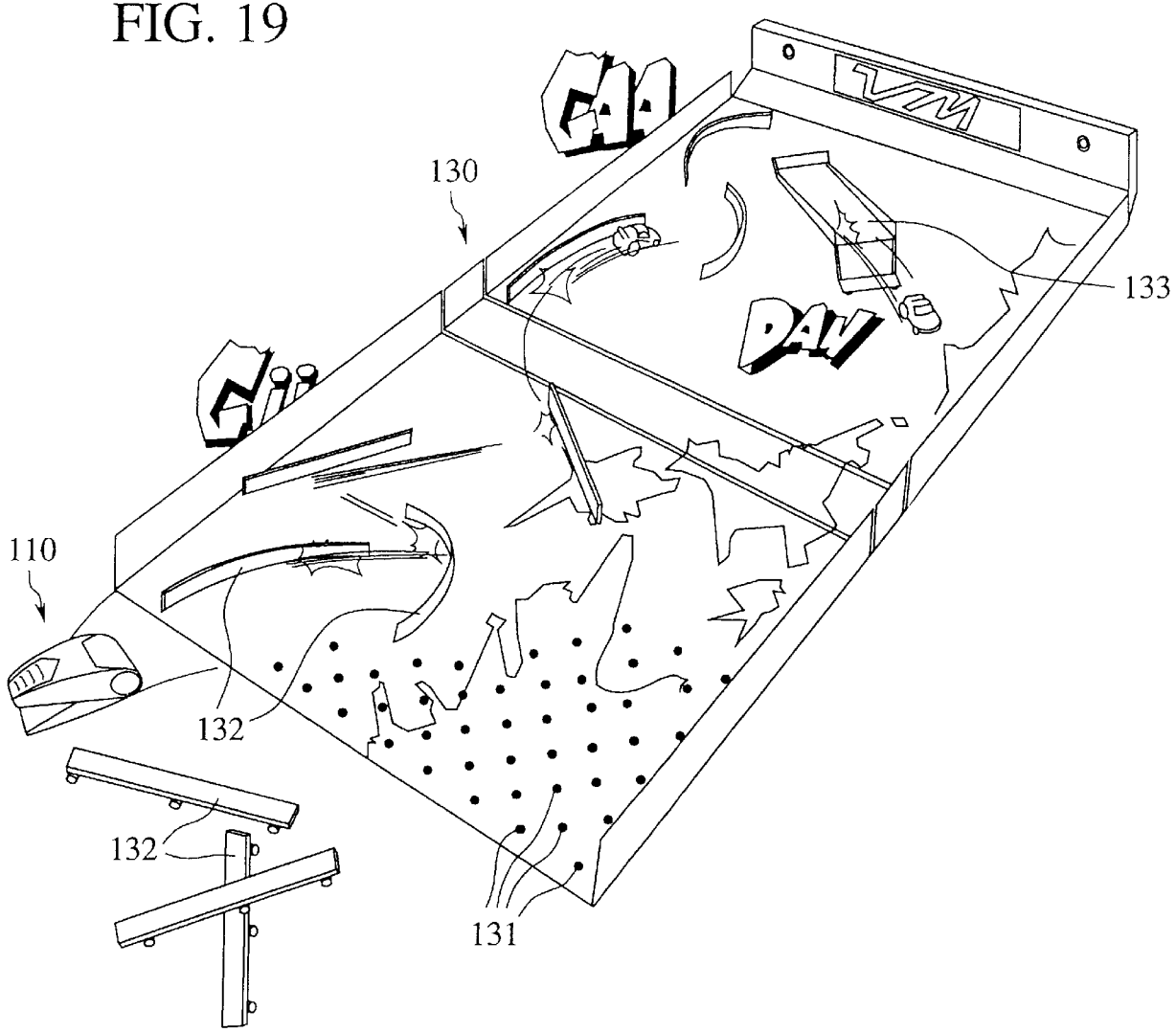
FIG. 19 is a perspective view of the running toy system according to the third embodiment of the present invention.

As shown in FIG. 19, the running toy system according to the present embodiment is in the form of a box-shaped free running course 130. The free running course 130 has a number of holes 131. A flexible guide rail 132 which is optionally curved is inserted in the holes 131 to design optional courses. A jumping board 133 may be inserted fixedly in holes 131 of the course 130 to give variety to the course 130.

In play, a rechargeable running toy 10 is charged by the charging means 110 and is started at a selected position outside the course 130 to run along the course 130.

Figure 20A:
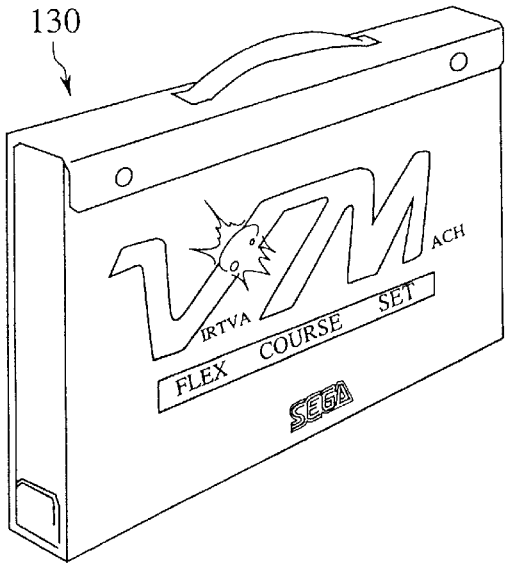
FIGS. 20A to 20C are perspective views of the running toy system according to the third embodiment of the present invention.

As shown in FIG. 20A, this free running course 130 is foldable and convenient to carry. Rechargeable running toys 10, the charging means 110, the flexible guide rail 132, the jumping board 133, etc. can be stowed in the folded free running course 130.

Figure 20B:
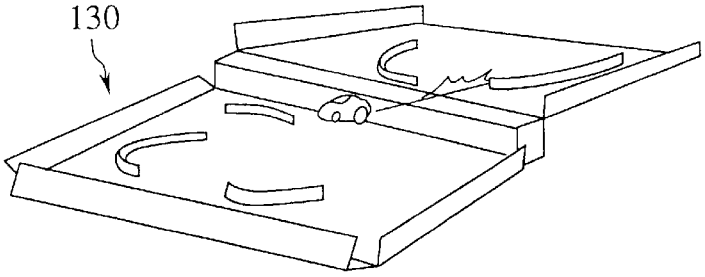
Figure 20C:
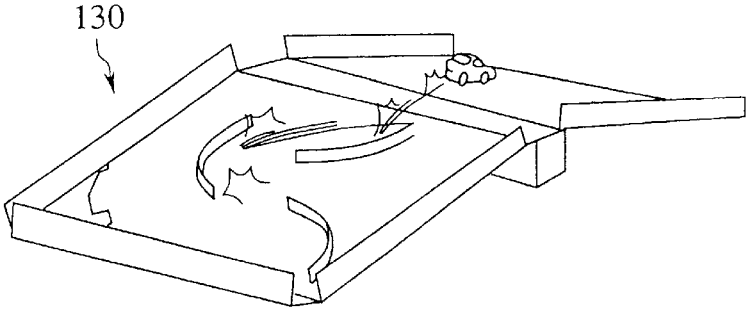

In FIG. 19, the free running course 130 is unfolded flat but, as shown in FIG. 20B, can have a large step at the center as an off-road course. Otherwise, as shown in FIG. 20C, the free running course 130 can be elevated at the center as a hill climbing course.

5. Running Toy System (4)

The running toy system according to a fourth embodiment of the present invention will be explained with reference to FIG. 21.

Figure 21:
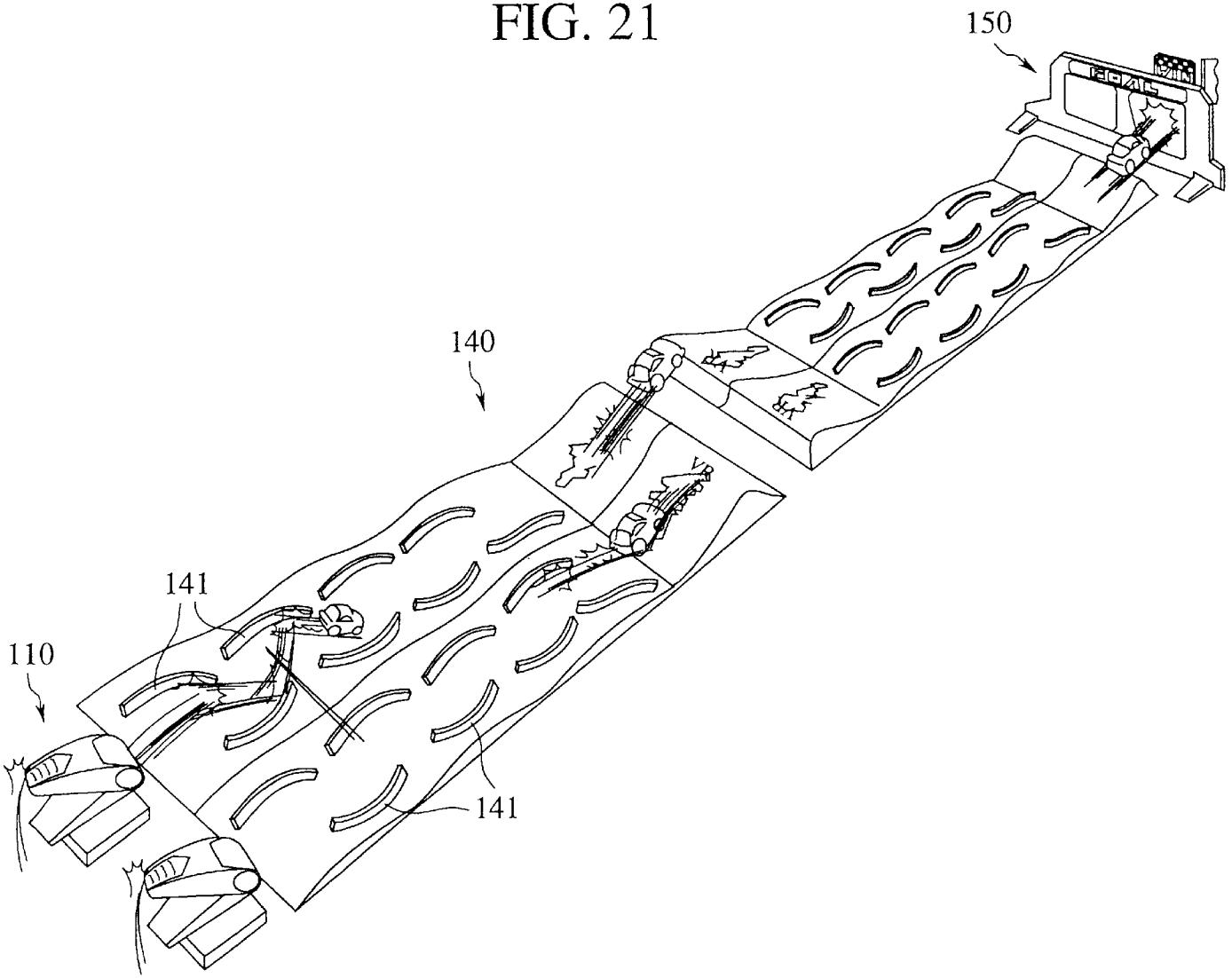
FIG. 21 is a perspective view of the running toy system according to the fourth embodiment of the present invention.

As shown in FIG. 21, the running toy system according to the present embodiment is in the form of a rough run course 140. The run course 140 has guide rails on respective courses which guide rechargeable running toys 10 zigzag pattern which prevents them from running off the courses. A gap which can be jumped over by the toys 10 is provided in the run course 140 to give variety to the run course 140.

At starting positions of the run course 140 there are provided the charging means which charges the rechargeable running toys 10. At finish positions of the run course 140 there is provided a goal display unit 150 which displays arrival of the rechargeable running toys 10.

Players charge the rechargeable running toys 10 by the charging means 110 and start their toys onto the run course 140 at the same time to compete in which of the toys is the first to arrive at the goal along the zigzag courses.

6. Variations

The rechargeable running toy and the running toy system according to the present invention can be developed as various types of rechargeable running toys and running toy systems in addition to the above-described embodiments.

For example, in the above-described embodiments the rechargeable running toys imitate cars but may imitate other vehicles, such as bikes, etc., or animals, such as dolls, horses, etc.

The running toy systems according to the above-described embodiments are mere examples and may be embodied as other amusing running toy systems utilizing the characteristic of a running toy that has a large capacity and that can be charged within a short time.

What is claimed is:

1. A charging device for use with a rechargeable running toy, the running toy having a charging terminal, the running toy having at least two wheels, one of the wheels being a drive wheel for propelling the running toy, the charging terminal being located on an underside of the running toy and between the at least two wheels, the running toy having a first distance between the charging terminal and the drive wheel; the charging device comprising:

a housing for accommodating a charging electric power source which supplies electric power, the housing having a terminal which is connectable to the charging electric power source;

a charging mount adapted to receive and charge the rechargeable running toy; and an electric power supply terminal provided at the charging mount and connectable to the terminal of said housing which is connectable to the charging electric power source, the distance between the power supply terminal and an end of the charging device nearest to the drive wheel when the running toy is placed at and aligned with the charging device being greater than the first distance;

the charging mount having a structure which, when the rechargeable running toy is placed at and aligned with the charging mount, causes the electric power supply terminal to be in electrical contact with the charging terminal of the rechargeable running toy, and causes the drive wheel of the rechargeable running toy to be out of contact with any part of the charging mount, thereby allowing the drive wheel to run free.

2. A charging device according to claim 1, wherein said structure, in response to the placement of the running toy on the charging mount, causes the electric power supply terminal to become projected relative to the charging mount so that the projected electric power supply terminal is brought into contact with the terminal of the rechargeable running toy.

3. A charging device according to claim 2, wherein said structure comprises a movable mounting plate for receiving the rechargeable running toy; and a presser plate which moves the mounting plate and causes the electric power supply terminal to become projected relative to the mounting plate when the presser plate is moved.

4. A charging device according to claim 2, further comprising a movable blocking gate provided in front of the charging mount which rises from the charging mount and blocks the rechargeable running toy when the electric power supply terminal is projected.

5. The charging device of claim 1, wherein the charging mount is separated from a runway along which the running toy runs.

6. A charging device for use with a rechargeable running toy, the running toy having a charging terminal and drive wheels for propelling the running toy, the charging device comprising:

a housing for accommodating a charging electric power source which supplies electric power, the housing having a terminal which is connectable to the charging electric power source;

a charging mount adapted to receive and charge the rechargeable running toy; and an electric power supply terminal provided at the charging mount and connectable to the terminal of said housing which is connectable to the charging electric power source;

the charging mount having a structure comprising a movable mounting plate, a presser plate and a cover provided above the charging mount, the cover being movable to a position where it covers a rechargeable running toy when received on the charging mount, the presser plate being moved in accordance with movement of the cover to said position, the presser plate causing movement of the mounting plate which causes the electric power supply terminal to become projected relative to the charging mount such that the electric power supply terminal is in electrical contact with the charging terminal of the rechargeable running toy, and causes the drive wheels of the rechargeable running toy to be out of contact with any part of the charging mount, thereby allowing the drive wheels to run free.

* * * * *

UNITED STATES PATENT AND TRADEMARK OFFICE

CERTIFICATE OF CORRECTION

PATENT NO. : 6,179,686 B1 
DATED : January 30, 2001
INVENTOR(S) : Iwakichi Ogawa et al.

It is certified that error appears in the above-identified patent and that said Letters Patent is hereby corrected as shown below:

Column 11,
Lines 23-53, please replace claim 1 with the following text:
1. A running toy system comprising:

a rechargeable running toy, the running toy having a charging terminal, the running toy having at least two wheels, one of the wheels being a drive wheel for propelling the running toy, the charging terminal being located on an underside of the running toy and between the at least two wheels; and a charging device comprising:

a housing for accommodating a charging electric power source which supplies electric power, the housing having a terminal which is connectable to the charging electric power source;

a charging mount portion adapted to receive and charge the rechargeable running toy;

and an electric power supply terminal provided at the charging mount portion and connectable to the terminal of said housing which is connectable to the charging electric power source;

the charging mount portion having a structure which, when the rechargeable running toy is placed at and aligned with the charging mount portion, causes the electric power supply terminal to be in electrical contact with the charging terminal of the rechargeable running toy, and causes the drive wheel of the rechargeable running toy to be out of contact with any part of the charging mount portion, thereby allowing the drive wheel to run free.

Column 11, Lines 54-55 and Column 12, Lines 1-5,
Please replace Claim 2 with the following text:
2. A running toy system according to claim 1, wherein said structure, in response to the placement of the running toy on the charging mount portion, causes the electric power supply terminal to become projected relative to the charging mount portion so that the projected electric power supply terminal is brought into contact with the terminal of the rechargeable running toy.

UNITED STATES PATENT AND TRADEMARK OFFICE

CERTIFICATE OF CORRECTION

PATENT NO. : 6,179,686 B1
DATED : January 30, 2001
INVENTOR(S) : Iwakichi Ogawa et al.

It is certified that error appears in the above-identified patent and that said Letters Patent is hereby corrected as shown below:

Column 12,

Lines 6-14, please replace Claim 3 with the following text:

3. A running toy system according to claim 2, wherein said structure comprises a movable mounting plate for receving the rechargable running toy; and a presser plate which moves the mounting plate and causes the electric power supply terminal to become projected relative to the mounting plate when the presser plate is moved.

Lines 15-19, please replace Claim 4 with the following text:

4. A running toy system according to claim 2, wherein said charging device further comprises a movable blocking gate provided in front of the chrging mount portion which rises from the charging mount portion and blocks the rcehargeable running toy when the electric power supply terminal is projected.

Lines 20-23, please replace Claim 5, with the following text:

5. The running toy system of claim 1, wherein the charging mount portion is separated from a runway along which the running toy runs.

Signed and Sealed this

Sixth Day of August, 2002

*Attest:*

*Attesting Officer*

JAMES E. ROGAN
*Director of the United States Patent and Trademark Office*